US012662783B2

(12) United States Patent
Seguin et al.

(10) Patent No.: US 12,662,783 B2
(45) Date of Patent: Jun. 23, 2026

(54) BARRIER FOR ROADWAY

(71) Applicant: INVESTISSEMENTS QMB INC., Laval (CA)

(72) Inventors: Marc-Andre Seguin, Beaconsfield (CA); Francis Beauchamp, Terrebonne (CA)

(73) Assignee: INVESTISSEMENTS QMB INC., Laval (CA)

( * ) Notice: Subject to any disclaimer, the term of this patent is extended or adjusted under 35 U.S.C. 154(b) by 253 days.

(21) Appl. No.: 18/374,266

(22) Filed: Sep. 28, 2023

(65) Prior Publication Data

US 2024/0110348 A1 Apr. 4, 2024

Related U.S. Application Data

(60) Provisional application No. 63/411,885, filed on Sep. 30, 2022.

(51) Int. Cl.
*E01F 15/08* (2006.01)

(52) U.S. Cl.
CPC ..... *E01F 15/088* (2013.01); *E01F 15/083* (2013.01)

(58) Field of Classification Search
CPC ..... E01F 15/006; E01F 15/08; E01F 15/081; E01F 15/083; E01F 15/088
See application file for complete search history.

(56) References Cited

U.S. PATENT DOCUMENTS 3,980,279 A * 9/1976 Bofinger ..... E01F 15/088 256/13.1
4,113,400 A * 9/1978 Smith ..... E01F 15/088 403/294

(Continued)

FOREIGN PATENT DOCUMENTS

AT 409393 B * 7/2002
AT 515842 A1 * 12/2015 ..... E01F 15/088

(Continued)

OTHER PUBLICATIONS

"Anchoring and Stiffening Techniques for Portable Concrete Barriers", by Bhakta, Surajkumar, University of Nebraska—Lincoln, Department of Mechanical & Materials Engineering, published in Nov. 2017, 68 pages.

(Continued)

*Primary Examiner* — Jonathan P Masinick

(57) ABSTRACT

A barrier for a roadway (e.g., a highway, bridge, or other road), which can be used to manage vehicular traffic, such as to establish lanes, protect motorists and other people (e.g., pedestrians, constructions workers, etc.) against crashes or other impacts, and/or other purposes, and which may be configured to enhance its use and performance, such as by better protecting the motorists and others when impacted by vehicles (e.g., reducing deflection by deflecting less or substantially not deflecting and/or otherwise improving protection provided by the barrier), facilitating transportation, installation, removal, and/or transfer of the barrier at the roadway, and/or enhancing other aspects of the barrier. For example, the barrier may be designed to protect against (e.g., prevent or reduce) deformation, breakage and/or other deterioration of interfaces (e.g., connections and/or interfacing material) of components of the barrier that may move relative to one another (e.g., when impacted by vehicles).

31 Claims, 18 Drawing Sheets

(56) References Cited

U.S. PATENT DOCUMENTS

| | | | | | |
|---|---|---|---|---|---|
| 4,496,264 | A * | 1/1985 | Casey | E01F 15/083 | 404/6 |
| 5,046,884 | A * | 9/1991 | Girotti | E01F 15/088 | 404/6 |
| 5,149,224 | A * | 9/1992 | Smith | E01F 15/083 | 404/9 |
| 5,464,306 | A * | 11/1995 | Cristiano | E01F 15/083 | 404/6 |
| 6,679,649 | B1 * | 1/2004 | Capolupo | E01F 15/083 | 404/6 |
| 6,951,434 | B2 * | 10/2005 | Yodock, Jr. | E01F 15/086 | 404/9 |
| 7,607,645 | B2 * | 10/2009 | Smith | E01F 15/088 | 404/6 |
| 7,654,768 | B1 † | 2/2010 | Tullis | | |
| 8,328,461 | B2 * | 12/2012 | Smith | E01F 15/088 | 404/6 |
| 8,388,257 | B2 * | 3/2013 | Redlberger | E01F 15/088 | 404/6 |
| 9,988,778 | B2 * | 6/2018 | Barnas | E01F 15/088 | |
| 10,407,855 | B2 * | 9/2019 | Cook | E01F 15/088 | |
| 10,422,092 | B1 * | 9/2019 | Maus | E01F 15/146 | |
| 10,774,489 | B1 * | 9/2020 | Yodock, Jr. | E02B 3/108 | |
| 11,028,545 | B2 * | 6/2021 | Powell | E01F 15/006 | |
| 11,028,546 | B2 * | 6/2021 | Edl | B28B 23/02 | |
| 11,111,081 | B1 * | 9/2021 | Provaznik | E01F 15/083 | |
| 12,391,149 | B2 * | 8/2025 | Strashny | B60M 1/30 | |
| 2005/0152744 | A1 * | 7/2005 | Straub | E02B 3/06 | 404/6 |
| 2012/0269574 | A1 * | 10/2012 | Redlberger | E01F 15/083 | 404/6 |
| 2016/0010294 | A1 * | 1/2016 | McMaster | E01F 15/088 | 29/897 |
| 2016/0145818 | A1 | 5/2016 | Schultz et al. | | |
| 2023/0035769 | A1 * | 2/2023 | Seguin | E01F 15/088 | |
| 2025/0163660 | A1 * | 5/2025 | Johansson | E01F 15/088 | |
| 2025/0198100 | A1 * | 6/2025 | Beauchamp | E01F 15/088 | |

FOREIGN PATENT DOCUMENTS

| | | | | | |
|---|---|---|---|---|---|
| AU | 2009353352 | B2 | 10/2013 | | |
| CA | 2006477 | A1 | 7/1990 | | |
| CH | 683540 | A5 * | 3/1994 | E01F 15/083 | |
| DE | 10311590 | A1 * | 9/2004 | E01F 15/083 | |
| DE | 102006041362 | A1 * | 3/2008 | E01F 15/025 | |
| DE | 102007006745 | A1 * | 8/2008 | E01F 15/088 | |
| DE | 102007048303 | A1 * | 4/2009 | E01F 15/025 | |
| DE | 102008026661 | A1 * | 12/2009 | E01F 15/083 | |
| DE | 102008045518 | A1 * | 3/2010 | E01F 15/083 | |
| DE | 102014114199 | A1 * | 3/2016 | E01F 15/083 | |
| DE | 102016006697 | A1 * | 11/2017 | E01F 15/088 | |
| EP | 0641893 | A1 * | 3/1995 | E01F 15/088 | |
| EP | 0641893 | † | 8/1997 | | |
| EP | 1467028 | A1 * | 10/2004 | E01F 15/088 | |
| EP | 2392734 | A1 * | 12/2011 | E01F 15/083 | |
| EP | 2644776 | † | 4/2018 | | |
| FR | 2783535 | A1 | 3/2000 | | |
| WO | WO-2009021290 | A1 * | 2/2009 | E01F 15/088 | |
| WO | 2011040902 | A1 | 4/2011 | | |

OTHER PUBLICATIONS

Examiner's Report issued on Apr. 3, 2024 in connection with Canadian Patent Application No. 3178032, 7 pages.

"Devis spécial—Maintien de la circulation et de la signalisation", issued by Transports, Mobilité durable et Électrification des transports Québec, 28 pages.(https://www.transports.gouv.qc.ca/fr/ministere/acces-information-renseignements-personnels/documents-reglement-diffusion/demande-acces/Documents/2019/10/DA-2019-2020-00292-devis-155.pdf).

Examiner's Report issued on Jul. 11, 2025 in connection with Canadian Patent Application No. 3178032, 10 pages.

Work Zone Safety Publication to Sheikh et al. (Sheikh et al.) Title: An Easy to use Pinned-Down Temporary Concrete Barrier with Limited Deflections Published: Nov. 15, 2008.†

* cited by examiner
† cited by third party

BARRIER FOR ROADWAY

CROSS-REFERENCE TO RELATED APPLICATIONS

This application claims the benefit of U.S. Provisional Patent Application Ser. No. 63/411,885, filed on Sep. 30, 2022. The contents of the aforementioned application are incorporated by reference herein.

FIELD

This disclosure relates generally to roadways and, more particularly, to barriers for roadways to manage traffic of vehicles.

BACKGROUND

Barriers for roadways (e.g., highways, bridges, and other roads) are used to manage traffic of vehicles, such as to establish lanes, protect motorists and other people (e.g., pedestrians, constructions workers, etc.) against crashes or other impacts, and/or other purposes.

Some barriers are fixed and/or permanent (e.g., such that they remain substantially stationary and/or are integrated into road infrastructures).

Others are movable barriers configured to be transferred between different locations by transfer vehicles (e.g., lifting and moving them), such as for lane management (e.g., reconfiguring lanes, such as for peak traffic times (e.g., "rush hour"), etc.), roadwork (e.g., construction sites to build or repair roads), etc.

While they are certainly useful and have evolved, existing barriers have some issues. For example, some barriers may sometimes deflect too much upon being impacted by vehicles, be expensive, etc.

For these and/or other reasons, there is a need to improve barriers for roadways.

SUMMARY

According to various aspects, this disclosure relates to a barrier for a roadway (e.g., a highway, bridge, or other road), which can be used to manage vehicular traffic, such as to establish lanes, protect motorists and other people (e.g., pedestrians, constructions workers, etc.) against crashes or other impacts, and/or other purposes, and which may be configured to enhance its use and performance, such as by better protecting the motorists and others when impacted by vehicles (e.g., reducing deflection by deflecting less or substantially not deflecting and/or otherwise improving protection provided by the barrier), facilitating transportation, installation, removal, and/or transfer of the barrier at the roadway, and/or enhancing other aspects of the barrier. For example, the barrier may be designed to protect against (e.g., prevent or reduce) deformation, breakage and/or other deterioration of interfaces (e.g., connections and/or interfacing material) of components of the barrier that may move relative to one another (e.g., when impacted by vehicles).

For example, according to one aspect, this disclosure relates a barrier for a roadway. The barrier comprises a plurality of barrier modules connected to one another. A given one of the barrier modules comprises a connector. An adjacent one of the barrier modules that is adjacent to the given one of the barrier modules comprises a connector for connecting to the connector of the given one of the barrier modules. The connector of the given one of the barrier modules comprises a reinforcement.

According to another aspect, this disclosure relates a barrier for a roadway. The barrier comprises a plurality of barrier modules connected to one another. Each of the barrier modules comprises a body including concrete. A given one of the barrier modules comprises a connector. An adjacent one of the barrier modules that is adjacent to the given one of the barrier modules comprises a connector for connecting to the connector of the given one of the barrier modules. The connector of the given one of the barrier modules comprises a reinforcement embedded in the concrete of the given one of the barrier modules.

According to another aspect, this disclosure relates a barrier for a roadway. The barrier comprises a plurality of barrier modules connected to one another. A given one of the barrier modules comprises a connector. An adjacent one of the barrier modules that is adjacent to the given one of the barrier modules comprises a connector for connecting to the connector of the given one of the barrier modules. The connector of the given one of the barrier modules comprises a reinforcement configured to maintain a shape of the connector of the given one of the barrier modules when the adjacent one of the barrier modules pivots relative to the given one of the barrier modules.

According to another aspect, this disclosure relates a barrier for a roadway. The barrier comprises a plurality of barrier modules connected to one another. A given one of the barrier modules comprises a connector. An adjacent one of the barrier modules that is adjacent to the given one of the barrier modules comprises a connector for connecting to the connector of the given one of the barrier modules. The connector of the given one of the barrier modules comprises a reinforcement configured to protect the connector of the given one of the barrier modules against deformation of the connector of the given one of the barrier modules when the adjacent one of the barrier modules pivots relative to the given one of the barrier modules.

According to another aspect, this disclosure relates a barrier for a roadway. The barrier comprises a plurality of barrier modules connected to one another. A given one of the barrier modules comprises a connector. An adjacent one of the barrier modules that is adjacent to the given one of the barrier modules comprises a connector for connecting to the connector of the given one of the barrier modules. The connector of the given one of the barrier modules comprises a reinforcement that is C-shaped when viewed in a heightwise direction of the given one of the barrier modules.

According to another aspect, this disclosure relates a barrier for a roadway. The barrier comprises a plurality of barrier modules connected to one another. A given one of the barrier modules comprises a connector. An adjacent one of the barrier modules that is adjacent to the given one of the barrier modules comprises a connector for connecting to the connector of the given one of the barrier modules. The connector of the given one of the barrier modules comprises a plurality of reinforcing members spaced from one another in a heightwise direction of the given one of the barrier modules.

According to another aspect, this disclosure relates a barrier for a roadway. The barrier comprises a plurality of barrier modules connected to one another. A given one of the barrier modules comprises a connector. An adjacent one of the barrier modules that is adjacent to the given one of the barrier modules comprises a connector for connecting to the connector of the given one of the barrier modules. The given one of the barrier modules comprises a base portion, an upper portion, and an intermediate portion between the base portion and the upper portion. The base portion of the given one of the barrier modules is wider than the intermediate portion of the given one of the barrier modules. The given one of the barrier modules comprises a reinforcement extending in the base portion of the given one of the barrier modules towards corners of the base portion of the given one of the barrier modules.

According to another aspect, this disclosure relates a barrier for a roadway. The barrier comprises a plurality of barrier modules connected to one another. Each of the barrier modules comprises a body including concrete. A given one of the barrier modules comprises a connector. An adjacent one of the barrier modules that is adjacent to the given one of the barrier modules comprises a connector for connecting to the connector of the given one of the barrier modules. The given one of the barrier modules comprises a base portion, an upper portion, and an intermediate portion between the base portion and the upper portion. The base portion of the given one of the barrier modules is wider than the intermediate portion of the given one of the barrier modules. The given one of the barrier modules comprises a reinforcement extending in the base portion of the given one of the barrier modules towards corners of the base portion of the given one of the barrier modules. The reinforcement is configured to maintain integrity of the concrete of the base portion of the given one of the barrier modules when the adjacent one of the barrier modules pivots relative to the given one of the barrier modules.

According to another aspect, this disclosure relates a barrier for a roadway. The barrier comprises a plurality of barrier modules connected to one another. Each of the barrier modules comprises a body including concrete. A given one of the barrier modules comprises a connector. An adjacent one of the barrier modules that is adjacent to the given one of the barrier modules comprises a connector for connecting to the connector of the given one of the barrier modules. The given one of the barrier modules comprises a base portion, an upper portion, and an intermediate portion between the base portion and the upper portion. The base portion of the given one of the barrier modules is wider than the intermediate portion of the given one of the barrier modules. The given one of the barrier modules comprises a reinforcement extending in the base portion of the given one of the barrier modules towards corners of the base portion of the given one of the barrier modules. The reinforcement is configured to protect the concrete of the base portion of the given one of the barrier modules against breakage of the concrete of the base portion of the given one of the barrier modules when the adjacent one of the barrier modules pivots relative to the given one of the barrier modules.

According to another aspect, this disclosure relates a barrier for a roadway. The barrier comprises a plurality of barrier modules connected to one another. A given one of the barrier modules comprises a connector. An adjacent one of the barrier modules that is adjacent to the given one of the barrier modules comprises a connector for connecting to the connector of the given one of the barrier modules. The given one of the barrier modules comprises a base portion, an upper portion, and an intermediate portion between the base portion and the upper portion. The base portion of the given one of the barrier modules is wider than the intermediate portion of the given one of the barrier modules. The given one of the barrier modules comprises a reinforcement extending in the base portion of the given one of the barrier modules towards corners of the base portion of the given one of the barrier modules. The reinforcement spans at least a majority of a width of the given one of the barrier modules.

According to another aspect, this disclosure relates a barrier for a roadway. The barrier comprises a plurality of barrier modules connected to one another. A given one of the barrier modules comprises a connector. An adjacent one of the barrier modules that is adjacent to the given one of the barrier modules comprises a connector for connecting to the connector of the given one of the barrier modules. The given one of the barrier modules comprises a base portion, an upper portion, and an intermediate portion between the base portion and the upper portion. The base portion of the given one of the barrier modules is wider than the intermediate portion of the given one of the barrier modules. The given one of the barrier modules comprises reinforcing legs disposed in the base portion of the given one of the barrier modules and extending opposite one another in a widthwise direction of the given one of the barrier modules.

According to another aspect, this disclosure relates a barrier for a roadway. The barrier comprises a plurality of barrier modules connected to one another. A given one of the barrier modules comprises a connector. An adjacent one of the barrier modules that is adjacent to the given one of the barrier modules comprises a connector for connecting to the connector of the given one of the barrier modules. The connector of the given one of the barrier modules comprises a vertical engageable part configured to engage the connector of the adjacent one of the barrier modules. The given one of the barrier modules comprises a base portion, an upper portion, and an intermediate portion between the base portion and the upper portion. The base portion of the given one of the barrier modules is wider than the intermediate portion of the given one of the barrier modules. The given one of the barrier modules comprises reinforcing legs disposed in the base portion of the given one of the barrier modules and extending from opposite sides of the vertical engageable part of the connector of the given one of the barrier modules.

According to another aspect, this disclosure relates a method of manufacturing a barrier for a roadway. The barrier comprises a plurality of barrier modules connected to one another. Each of the barrier modules comprises a body including concrete. A given one of the barrier modules comprises a connector. An adjacent one of the barrier modules that is adjacent to the given one of the barrier modules comprises a connector for connecting to the connector of the given one of the barrier modules. The connector of the given one of the barrier modules comprises a reinforcement. The method comprises pouring the concrete of the given one of the barrier modules into a mold to form the body of the given one of the barrier modules and forcing the concrete around the reinforcement in the mold.

According to another aspect, this disclosure relates a method of manufacturing a barrier for a roadway. The barrier comprises a plurality of barrier modules connected to one another. Each of the barrier modules comprises a body including concrete. A given one of the barrier modules comprises a connector. An adjacent one of the barrier modules that is adjacent to the given one of the barrier modules comprises a connector for connecting to the connector of the given one of the barrier modules. The given one of the barrier modules comprises a base portion, an upper portion, and an intermediate portion between the base portion and the upper portion. The base portion of the given one of the barrier modules is wider than the intermediate portion of the given one of the barrier modules. The given one of the barrier modules comprises a reinforcement extending in the base portion of the given one of the barrier modules towards corners of the base portion of the given one of the barrier modules. The method comprises pouring the concrete of the given one of the barrier modules into a mold to form the body of the given one of the barrier modules and forcing the concrete around the reinforcement in the mold.

These and other aspects of this disclosure will now become apparent to those of ordinary skill upon review of a description of embodiments that follows in conjunction with accompanying drawings.

BRIEF DESCRIPTION OF DRAWINGS

A detailed description of embodiments is provided below, by way of example only, with reference to accompanying drawings, in which.

It is to be expressly understood that the description and drawings are only for purposes of illustrating certain embodiments and are an aid for understanding. They are not intended to be and should not be limiting.

DETAILED DESCRIPTION OF EMBODIMENTS

Figure 1:
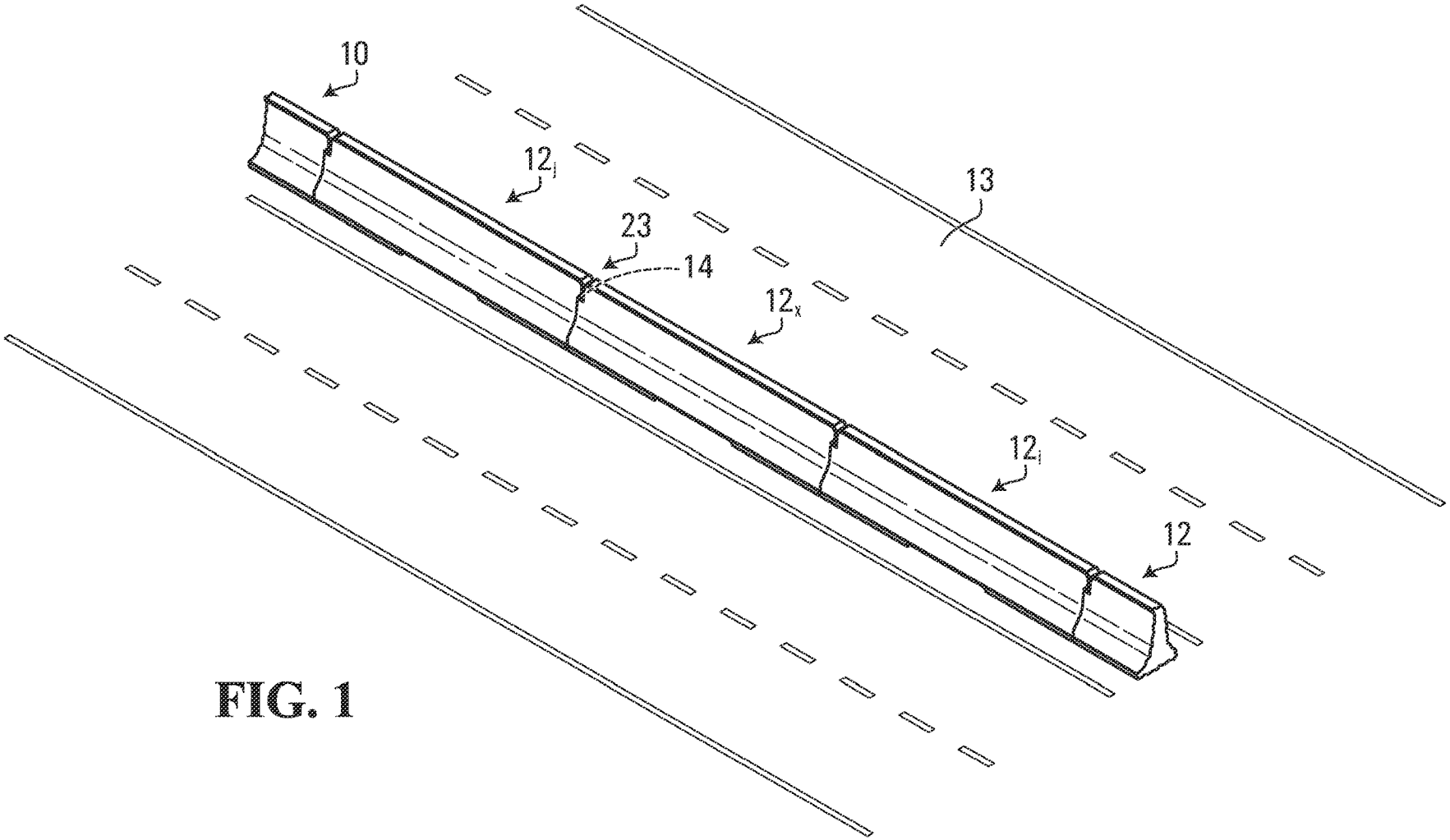
FIG. 1 shows an embodiment of a barrier for a roadway comprising a plurality of barrier modules.

FIG. 1 shows an embodiment of a barrier 10 for a roadway 13 (e.g., a highway, bridge, or other road). The barrier 10 can be used to manage vehicular traffic, such as to establish lanes, protect motorists and other people (e.g., pedestrians, constructions workers, etc.) against crashes or other impacts, and/or other purposes. In this embodiment, the barrier 10 is fixed and/or permanent (e.g., such that it remains substantially stationary and/or is integrated into an infrastructure of the roadway 13). More particularly, in this embodiment, the barrier 10 is a Jersey barrier to separate lanes of the roadway 13.

As further discussed below, in various embodiments, the barrier 10 may be configured to enhance its use and performance, such as by better protecting motorists and others when impacted by vehicles (e.g., reducing deflection by deflecting less or substantially not deflecting and/or otherwise improving protection provided by the barrier 10), facilitating transportation, installation and/or removal of the barrier 10 at the roadway 13, and/or enhancing other aspects of the barrier 10. For example, in some embodiments, this may be achieved by designing the barrier 10 to protect against (e.g., prevent or reduce) deformation, breakage and/or other deterioration of interfaces (e.g., connections and/or interfacing material) of components of the barrier 10 that may move relative to one another (e.g., when impacted by vehicles).

The barrier 10 comprises a plurality of barrier modules 12 connected to one another. This allows a length of the barrier 10 to be set as desired for the roadway 13. The barrier 10 has a longitudinal direction, a heightwise direction, and a widthwise direction. Similarly, each of the barrier modules 12 has a longitudinal direction, a heightwise direction, and a widthwise direction.

Figure 2:
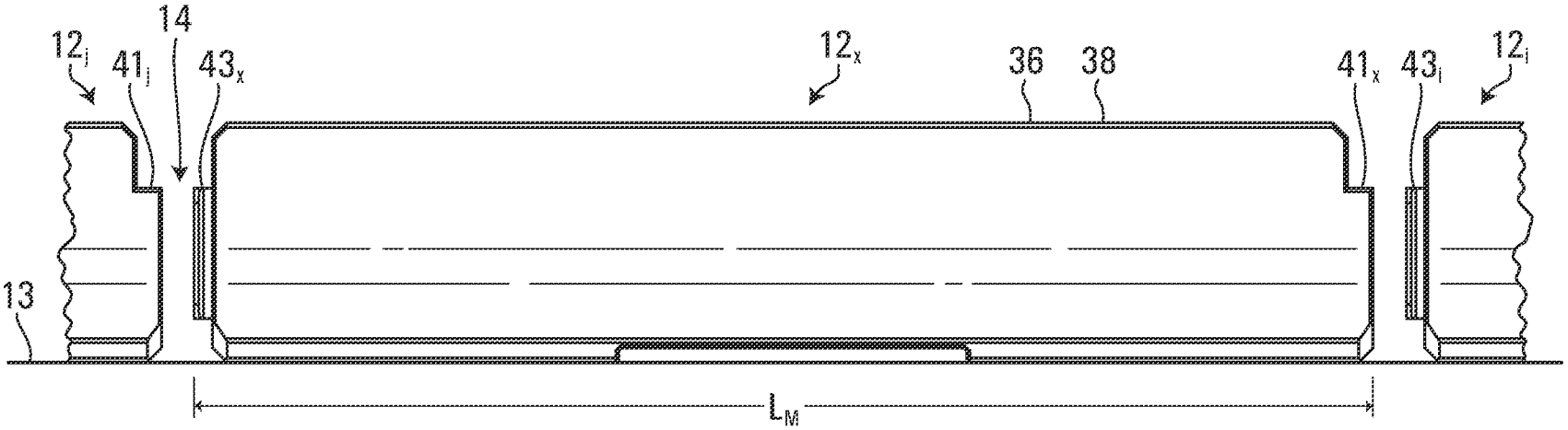
FIG. 2 shows a side elevation view of a given barrier module of the barrier of FIG. 1, a partial side elevation view of a first barrier module adjacent to the given barrier module and a partial side elevation view of a second barrier module adjacent to the given barrier module.
Figure 3:
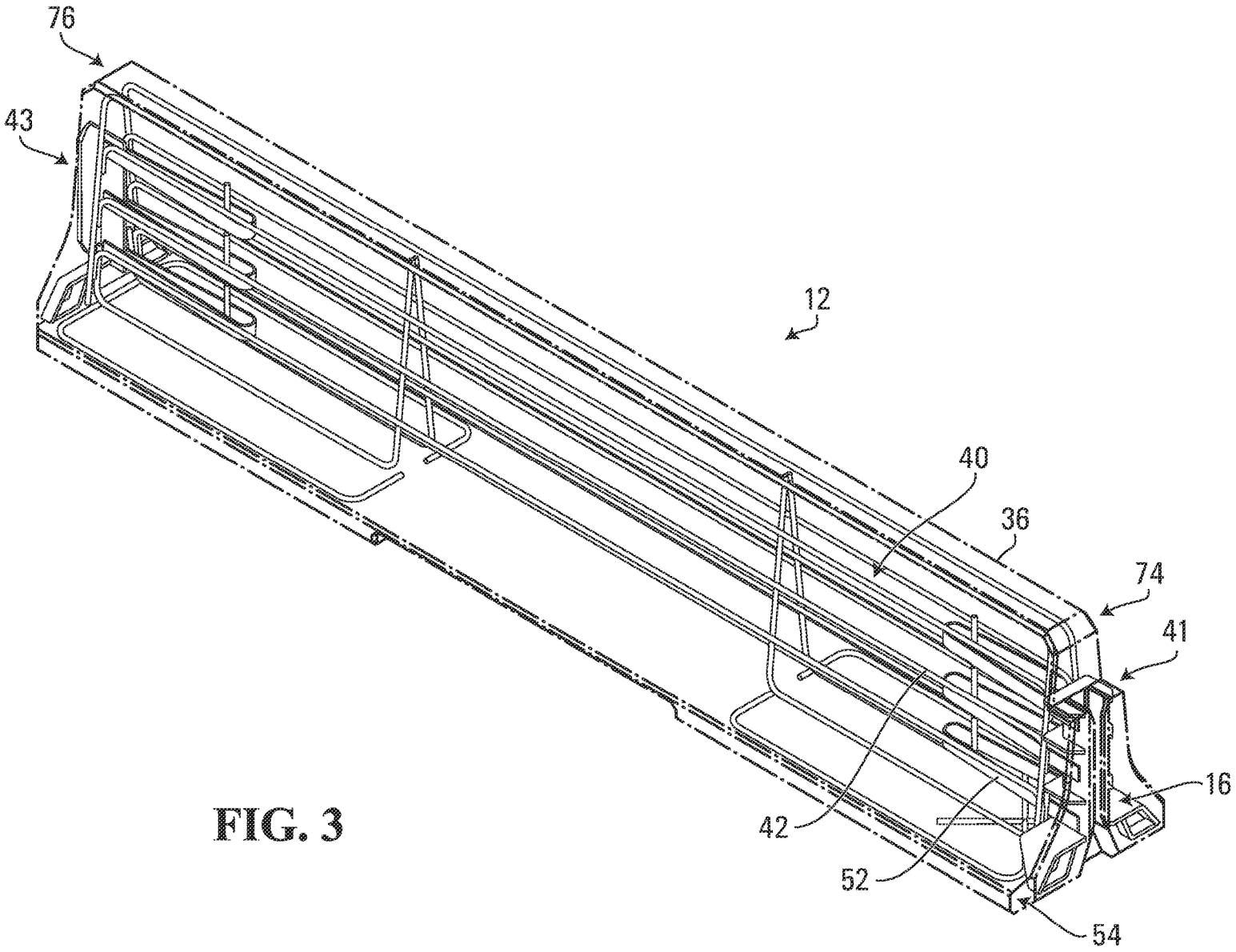
FIGS. 3 and 4 show first and second isometric views of a barrier module, including an armature and a reinforcement that are shown in phantom line.
Figure 4:
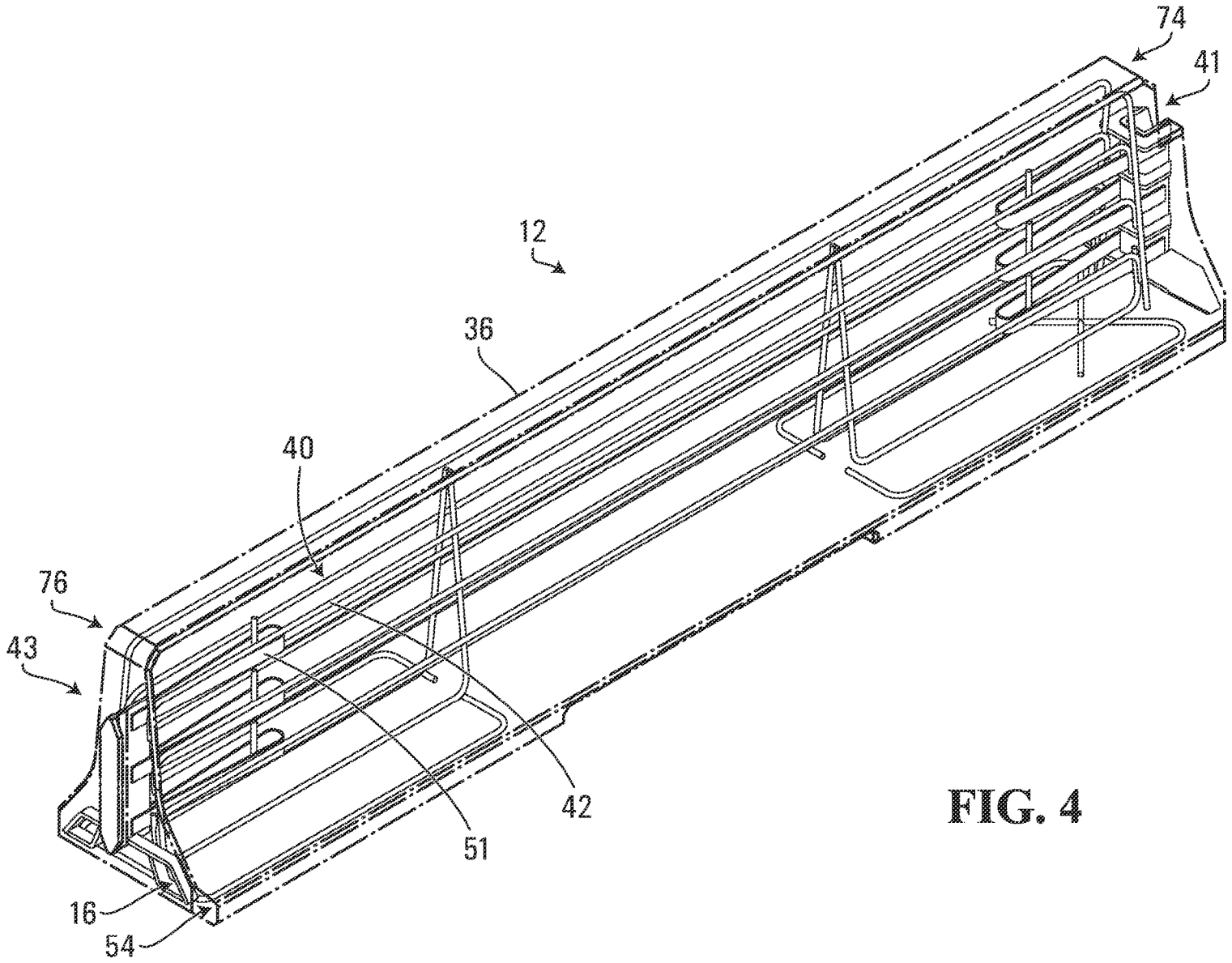

With additional reference to FIGS. 1 and 2, the barrier 10 comprises a connection system 14 to interconnect the barrier modules 12. The connection system 14 includes connections 23 of respective ones of the barrier modules 12 that are adjacent. The connections 23 allow the barrier modules 12 to be connected to one another when the barrier 10 is installed and, in some cases, possibly disconnected from one another when the barrier 10 is removed. In some embodiments, the connections 23 may also allow the barrier modules 12 to move (e.g., pivot) relative to one another (e.g., when impacted and/or transferred at the roadway 13).

A length $L_M$ of each of the barrier modules 12 may have any suitable value. For example, in some embodiments, the length $L_M$ of the barrier module 12 may be at least 4 meters (m). In other embodiments, the length $L_M$ of the barrier module 12 may be shorter or longer. For instance, in some embodiments, the length $L_M$ of the barrier module 12 may be at least 1 m, in some cases at least 2 m, and in some cases at least 3 m.

As shown in FIGS. 5 to 8, each barrier module 12 comprises a base portion 30, an upper portion 32, and an intermediate portion 34 between its base portion 30 and its upper portion 32. In this embodiment, the base portion 30 of the barrier module 12 is wider than the intermediate portion 34 and the upper portion 32 of the barrier module 12. This enhances stability of the barrier module 12, while minimizing damage to an impacting vehicle which impacts the barrier module 12. The body 36 of the barrier module 12 comprises lateral surfaces 57, 59. Also, in this embodiment, lateral surfaces 57, 59 of the barrier module 12 are inclined relative to the heightwise direction $H_M$ of the barrier module 12 in the base portion 34, the intermediate portion 34 and the upper portion 32 of the barrier module 12, in different degrees in those portions of the barrier module 12, such that the barrier module 12 tapers upwardly.

A width $W_M$ of each of the barrier modules 12 may have any suitable value. For example, in some embodiments, the width $W_M$ of each barrier module 12 may be at least 18 inches or at least 24 inches.

A height $H_M$ of each of the barrier modules 12 may have any suitable value. For example, in some embodiments, the height $H_M$ of each barrier module 12 may be at least 32 inches or at least 42 inches.

Each barrier module 12 comprises a first end 74 and a second end 76 opposite the first end 74. The first and second ends 74, 76 of the barrier module 12 define the length $L_M$ of the barrier module 12.

Each barrier module 12 comprises a body 36. In this embodiment, the body 36 of the barrier module 12 includes concrete 38 (e.g., a concrete casting). In this example, the concrete 38 forms at least part of a periphery of the body 36 of the barrier module 12.

Also, in this embodiment, the body 36 of the barrier module 12 comprises an armature 40 embedded in the concrete 38 (e.g., for reinforcing the body 36 of the barrier module 12 and/or facilitating manufacturing of the barrier module 12). The armature 40, which may sometimes be referred to as a frame or brace, may comprise any suitable material. For instance, the armature 40 may comprise a metallic material (e.g., steel).

A value of the modulus of elasticity of the material of the armature 40 may have any suitable value. In certain embodiments, the material of the armature 40 may have a modulus of elasticity of at least 300 MPa, in some cases at least 400 MPa. The material of the armature 40 may have any suitable hardness.

In this example, the armature 40 comprises a plurality of structural members 42 spaced from one another. In this case, respective ones of the structural members 42 are elongate in the longitudinal direction of the barrier 10.

In some cases, respective ones of the structural members 42 may extend in the longitudinal direction of the barrier 10. In some cases, respective ones of the structural members 42 may extend in the widthwise direction of the barrier 10. In yet other cases, respective ones of the structural members 42 may extend in the heightwise direction of the barrier 10. In yet another example, the respective ones of the structural members 42 extending in the heightwise direction of the barrier 10 may be inclined with respect to the heightwise direction of the barrier 10.

In some cases, the structural members 42 may have a circular cross-section. The structural members 42 may have any other cross-sectional shape in other cases.

In some embodiments, the body 36 of the barrier module 12 may be configured without an armature. In such embodiments, the body 36 of the barrier module 12 may comprise fiber-filled concrete (e.g., synthetic fibers, glass fibers, metallic fibers).

Figure 5:
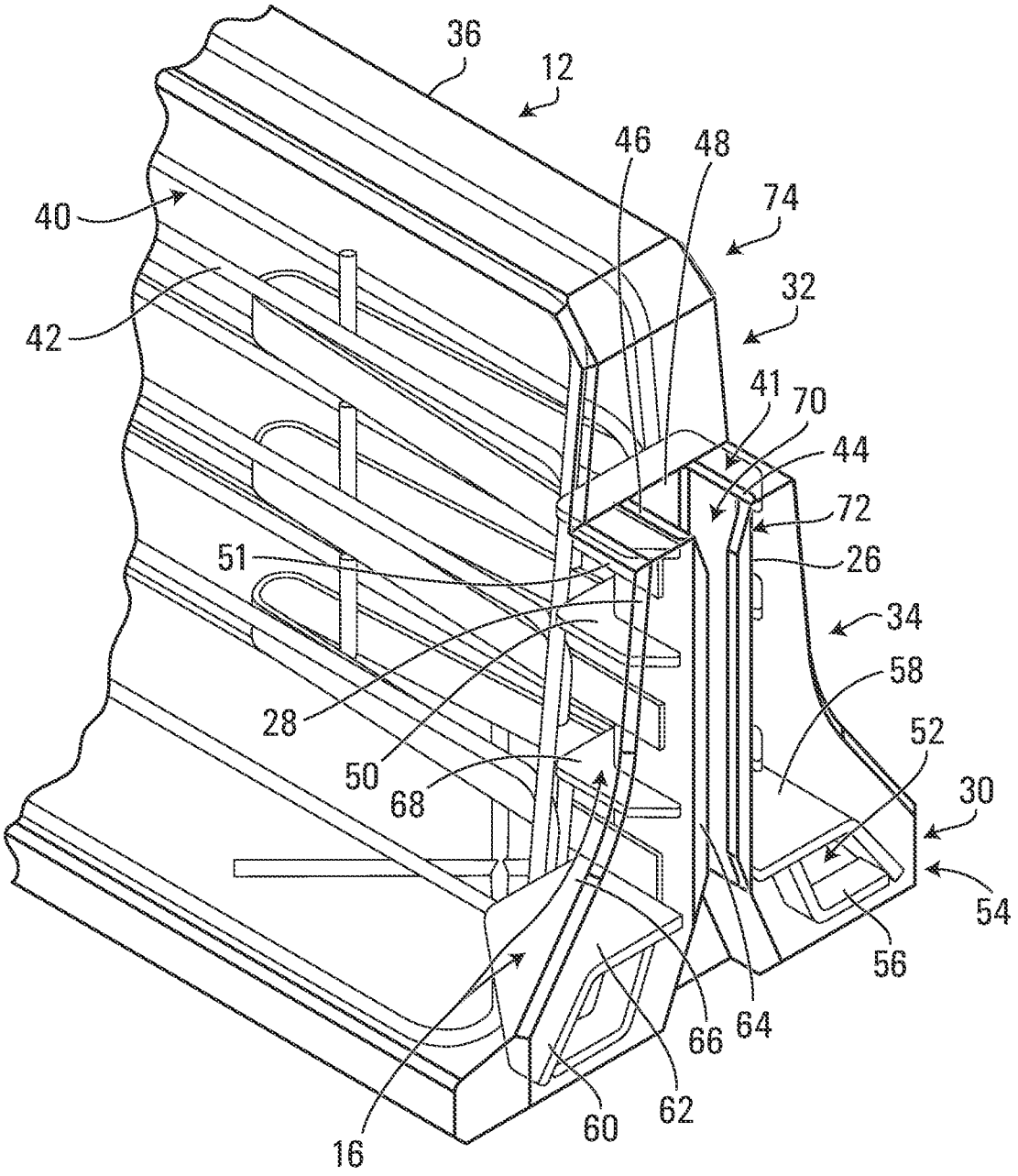
FIG. 5 shows an isometric view of a first end of the barrier module of FIGS. 3 and 4.
Figure 6:
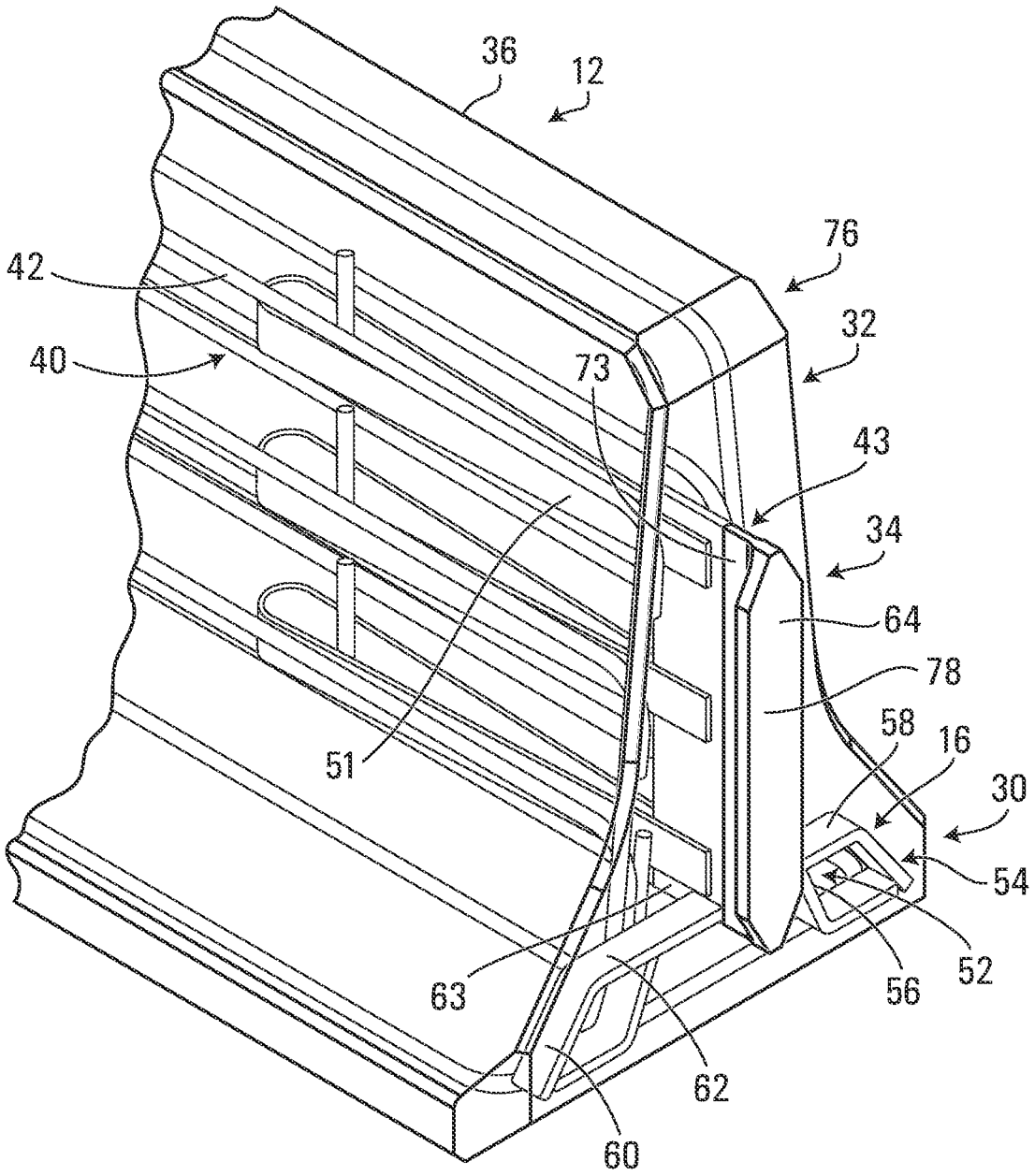
FIG. 6 shows an isometric view of a second end of the barrier module of FIGS. 3 and 4.

In this embodiment, as shown in FIGS. 5 and 6, the barrier module 12 also includes a plurality of anchors 51. In this example of implementation, respective ones of the anchors 51 extend from the first end 74 toward a center of the barrier module 12 in the longitudinal direction of the barrier module 12 and respective ones of the anchors 51 extend from the second end 76 toward the center of the barrier module 12 in the longitudinal direction of the barrier module 12. In some cases, the anchors 51 may span at least one-eighth of the length $L_M$ of the barrier module 12. In other cases, the anchors 51 may span less or more than one-eight of the length $L_M$ of the barrier module 12.

In this embodiment, as part of the connection system 14 of the barrier 10, each barrier module 12 comprises connectors 41, 43 configured to connect the barrier module 12 to one or more adjacent barrier modules 12. For example, considering a given one of the barrier modules 12, which is denoted $\mathbf{12}_x$ and disposed between adjacent ones of the barrier modules that are denoted $\mathbf{12}_i$ and $\mathbf{12}_i$, as shown in FIG. 2, the connector 41 of the barrier module $\mathbf{12}_x$ is for connecting to the connector 43 of the adjacent barrier module $\mathbf{12}_i$, while the connector 43 of the barrier module $\mathbf{12}_x$ is for connecting to the connector 41 of the adjacent barrier module $\mathbf{12}_i$.

The connector 41 of the barrier module 12 is disposed at the first end 74 of the barrier module 12 and the connector 43 of the barrier module 12 is disposed at the second end 76 of the barrier module 12. In this embodiment, the connector 41 is a female connector and the connector 43 is a male connector configured to be received in the female connector 41. More particularly, in this embodiment, the female connector 41 of the barrier module 12 includes a cavity 70 to receive the male connector 43 of an adjacent barrier module 12 (e.g., the cavity 70 of the connector 41 of the given barrier module $\mathbf{12}_x$ is configured to receive the male connector 43 of the adjacent barrier module $\mathbf{12}_i$).

The connectors 41, 43 may comprise any suitable material 64. For instance, the connectors 41, 43 may comprise a metallic material (e.g., steel).

In this embodiment, as shown for example in FIGS. 5 and 6, at least part of each of the connectors 41, 43 of the barrier module 12 is disposed outside the concrete 38 of body 36 of the barrier module 12.

As previously discussed, in this embodiment, respective ones of the anchors 51 extend from the first end 74 toward the center of the barrier module 12 and from the second end 76 toward the center of the barrier module 12. With continued reference to FIGS. 5 and 6, in this embodiment, respective ones of the anchors 51 extend from the each of the connectors 41, 43 towards the center of the barrier module 12 in the longitudinal direction of the barrier module 12. Thus, in this example of implementation of the embodiment, respective ones of the anchors 51 are coupled to (e.g., affixed to) at least a portion of each of the connectors 41, 43 of the barrier module 12 (e.g., the portion of each of the connectors 41, 43 disposed within the concrete 38 of the body 36 of the barrier module 12).

In some embodiments, the anchors 51 may be affixed to the connectors 41, 43 of the barrier module 12 in any suitable fashion (e.g., by being welded, bonded, mechanically fastened, etc.). In other embodiments, the anchors 51 may be integrally formed (e.g., molded, forged, etc.) with the connectors 41, 43 of the barrier module 12.

Figure 7:
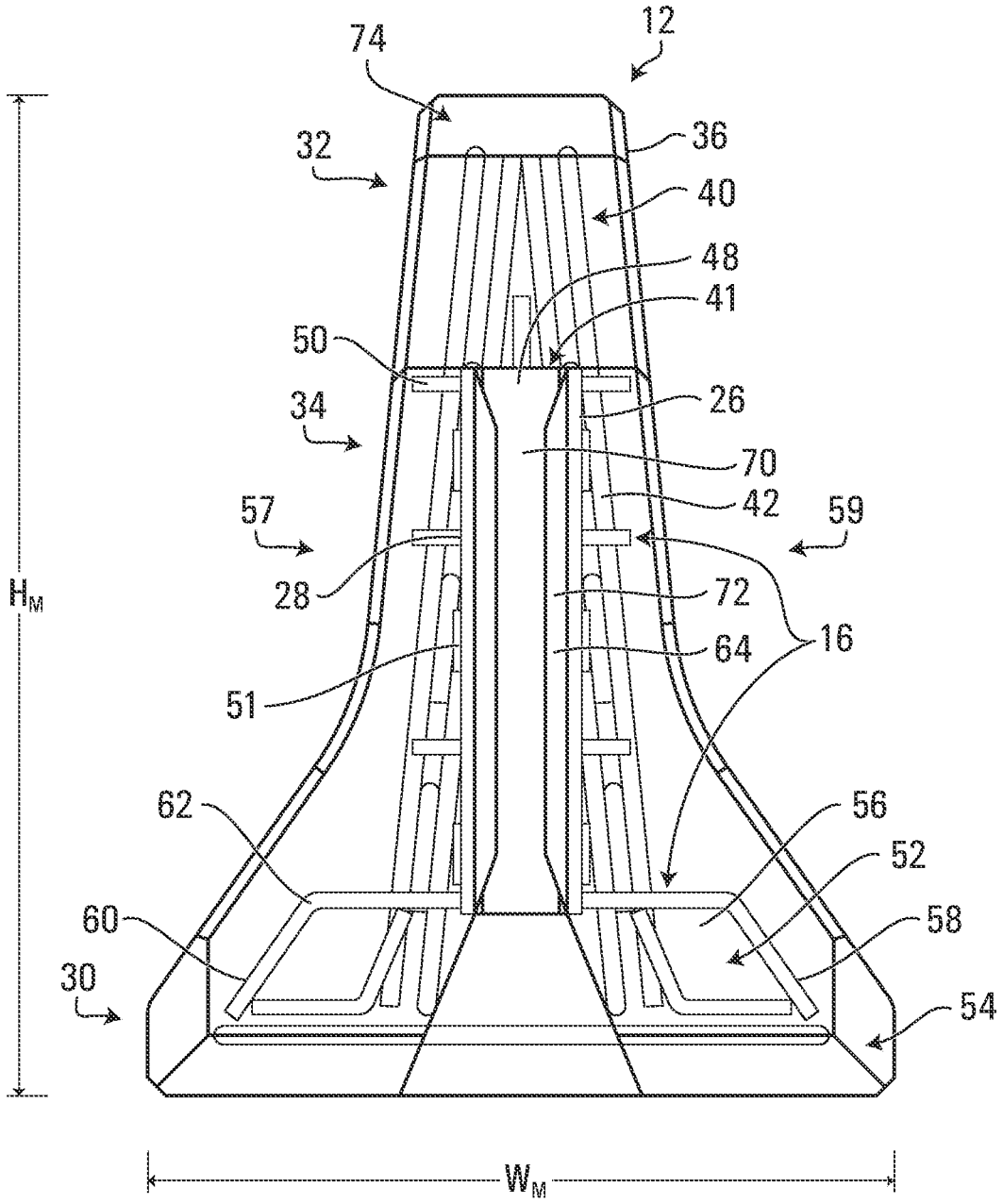
FIG. 7 shows an elevation view of the first end of the barrier module of FIGS. 3 and 4 comprising a first connector.

With continued reference to FIGS. 5 and 7, in this embodiment, the connector 41 of the barrier module 12 includes a vertical engageable part 72 which is configured to engage the connector 43 of an adjacent barrier module 12 (e.g., the vertical engageable part 72 of the connector 41 of the given barrier module $\mathbf{12}_x$ is configured to engage the connector 43 of the adjacent barrier module $\mathbf{12}_i$). In this example, the vertical engageable part 72 of the connector 41 of the barrier module 12 includes lateral walls 44, 46 spaced apart in the widthwise direction of the barrier module 12 and an end wall 48 between the lateral walls 44, 46. The lateral walls 44, 46 and the end wall 48 define the cavity 70 of the connector 41.

A height of the connector 41 of the barrier module 12 may have any suitable value. For instance, in some cases the height of the connector 41 of the barrier module 12 may span at least one-third, in some cases at least half and in some cases at least two-thirds of the height $H_M$ of the given barrier module 12. For instance, in some examples, the height of the connector 41 of the barrier module 12 may span a majority of the height $H_M$ of the given barrier module 12. The height of the connector 41 may be defined by a height of the vertical engageable part 72 of the connector 41 of the barrier module 12.

Figure 8:
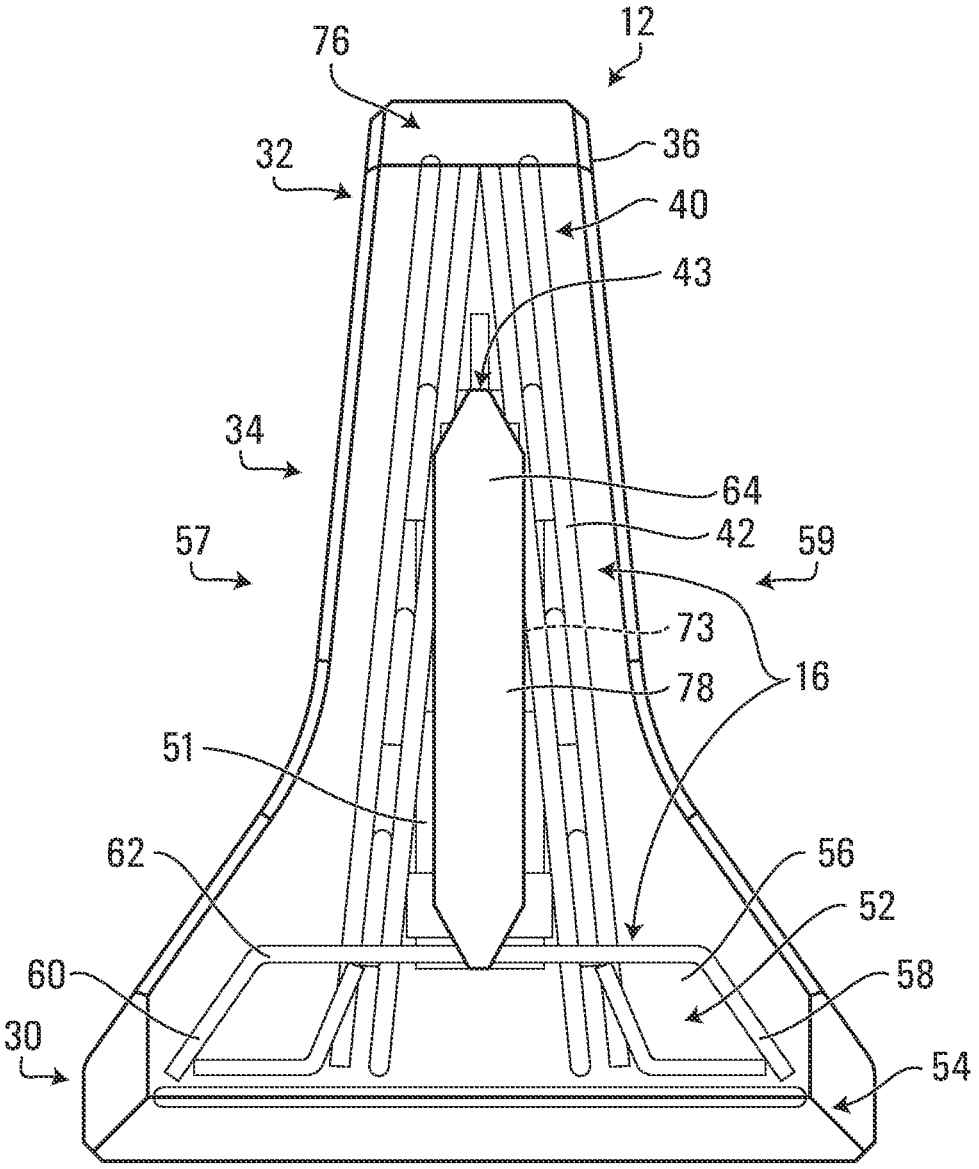
FIG. 8 shows an elevation view of the second end of the barrier module of FIGS. 3 and 4 comprising a second connector.

In this embodiment, as shown in FIGS. 6 and 8, the male connector 43 of the barrier module 12 also includes a vertical engageable part 73 which is configured to engage the connector 41 of an adjacent barrier module 12 (e.g., the vertical engageable part 73 of the connector 43 of the given barrier module $\mathbf{12}_x$ is configured to engage the vertical engageable part 72 of the connector 41 of the adjacent barrier module 120. In this case, the connector 43 of the barrier module 12 is configured to hook into the connector 41 of an adjacent barrier module 12. Thus, when the barrier module 12 is connected to an adjacent barrier module 12, the connector 43 of the barrier module 12 is at least partially disposed within the cavity 70 of the connector 41 of the adjacent barrier module 12 (e.g., the connector 43 of the given barrier module $\mathbf{12}_x$ is at least partially disposed within the cavity 70 of the connector 41 of the adjacent barrier module 120.

More particularly, in this embodiment, the vertical engageable part 73 of the male connector 43 of the barrier module 12 comprises a projection 78 projecting outwardly. The projection 78 is configured to be received by the female connector 41 of an adjacent barrier module 12. In this example of implementation, the projection 78 of the connector 43 of the barrier module 12 is configured to be disposed at least partially in the cavity 70 of the connector 41 of an adjacent barrier module 12 (e.g., the projection 78 of the connector 43 of the given barrier module $\mathbf{12}_x$ is configured to be disposed at least partially in the cavity 70 of the connector 41 of the adjacent barrier module $\mathbf{12}_i$). In this case, the connector 43 of the barrier module 12 is configured to hook into the connector 41 of the adjacent barrier module 12.

The projection 78 may have any suitable shape. In this case, the shape of the projection 78 may be described as a double-ended arrow or, when viewed in the heightwise direction of the barrier module 12, as a T-shaped projection.

A height of the connector 43 of the barrier module 12 may have any suitable value. For instance, in some cases the height of the connector 43 of the barrier module 12 may span at lest one-third, in some cases at least half and in some cases at least two-thirds of the height $H_M$ of the barrier module 12. For instance, in some examples, the height of connector 43 of the given barrier module 12 may span a majority of the height $H_M$ of the barrier module 12. The height of the connector 43 may be defined by a height of the vertical engageable part 73 of the connectors 43 of the barrier module 12. Alternatively, the height of the connector 43 may be defined by a length of the projection 78 of the vertical engageable part 73 of the connector 43.

The connectors 41, 43 may be implemented in various other ways in other embodiments.

Figure 15:
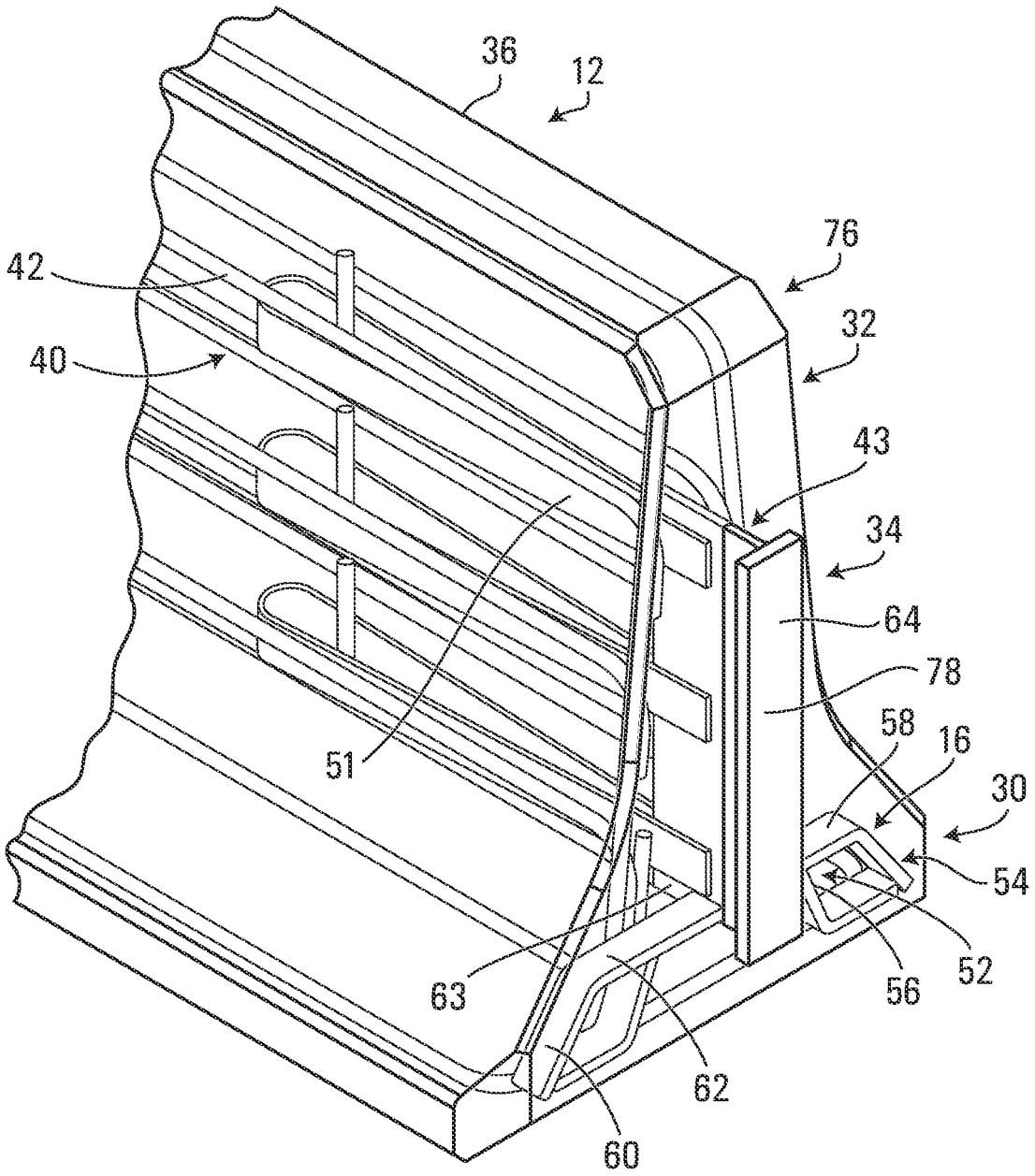
FIG. 15 shows another embodiment of a connector of the barrier module.

For example, with reference to FIG. 15, the shape of the projection 78 of the male connector 43 may be described a T-shaped projection (when viewed in the heightwise direction of the barrier module 12 as well as when viewed cross-sectionally).

Figure 16:
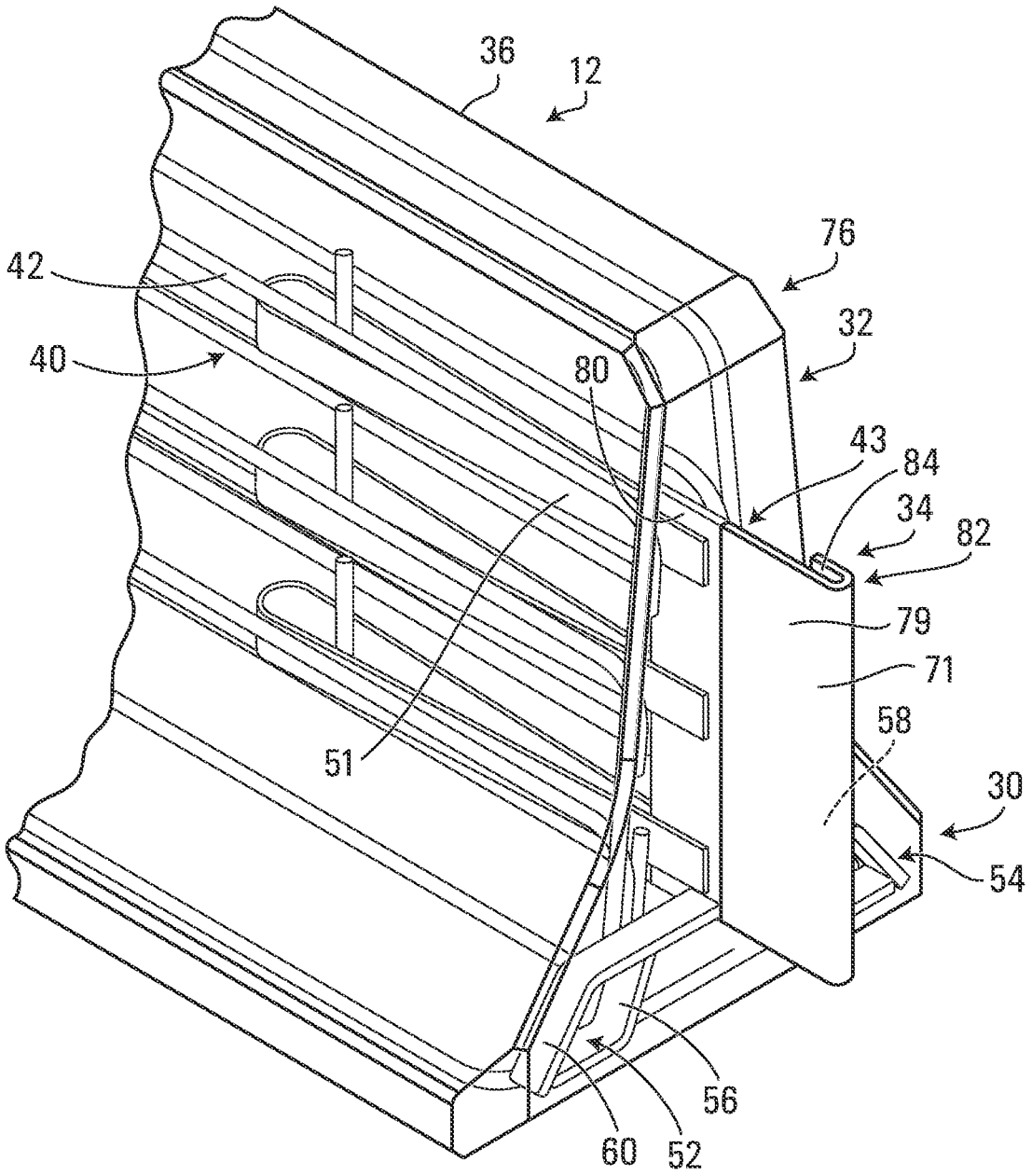
FIGS. 16 and 17 show another embodiment of a connector of the barrier module.
Figure 17:
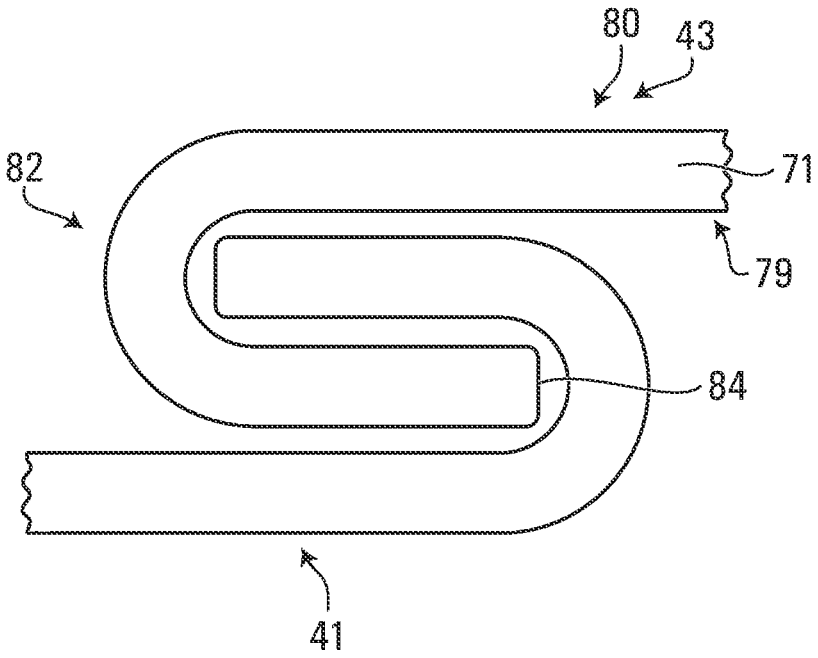

In yet another example, with reference to FIGS. 16 and 17, the female connector 41 and the male connector 43 may have a substantially similar shape or an identical shape. In this embodiment, the female connector 41 and the male connector 43 may be viewed as having a J-shaped projection (e.g., such as so-called "JJ-Hooks" barrier modules).

In this example of implementation, each of the connectors 41, 43 include a vertical engageable part 79. The vertical engageable part 79 comprises a projection 71 projecting outwardly. A proximal portion 80 of the projection 71 is substantially planar and a distal portion 82 of the projection 71 is U-shaped such that the distal portion 82 of the projection 71 includes a cavity 84. In this case, the shape of the projection 79 may be described as a J-shaped projection when viewed in the heightwise direction of the barrier module 12.

In this example, the vertical engageable part 79 of the connector 41 of the barrier module 12 is configured to engage the vertical engageable part 79 of the connector 43 of an adjacent barrier module 12 (e.g., the vertical engageable part 79 of the connector 41 of the given barrier module $\mathbf{12}_x$ is configured to engage the vertical engageable part 79 of the connector 43 of the adjacent barrier module $\mathbf{12}_i$). In this case, the connector 41 of the barrier module 12 is configured to hook into the connector 43 of an adjacent barrier module 12. Thus, when the barrier module 12 is connected to an adjacent barrier module 12, the connector 41 of the barrier module 12 is at least partially disposed within the cavity 84 of the connector 43 of the adjacent barrier module 12 and the connector 43 of the barrier module 12 is at least partially disposed within the cavity 84 of the connector 41 of the adjacent barrier module 12 (e.g., the connector 41 of the given barrier module $\mathbf{12}_x$ is at least partially disposed within the cavity 84 of the connector 43 of the adjacent barrier module $\mathbf{12}_i$ and the connector 43 of the given barrier module $\mathbf{12}_i$ is at least partially disposed within the cavity 84 of the connector 41 of the adjacent barrier module $\mathbf{12}_x$). Accordingly, the projection 71 of the connector 41 of a barrier module 12 is configured to be received by the projection 71 of the connector 43 of an adjacent barrier module 12.

In some situations, barriers for roadways may be impacted by vehicles. Such an impact may cause a barrier to deflect and/or may damage the barrier. For instance, in some cases, the barrier may be damaged such that one or more connections between barrier modules of the barrier is damaged. Additionally and/or alternatively, the barrier may be damaged such that portions of a body of one or more of its barrier modules may be damaged. Such damage may decrease the effectiveness of the barrier at controlling traffic.

Figure 13:
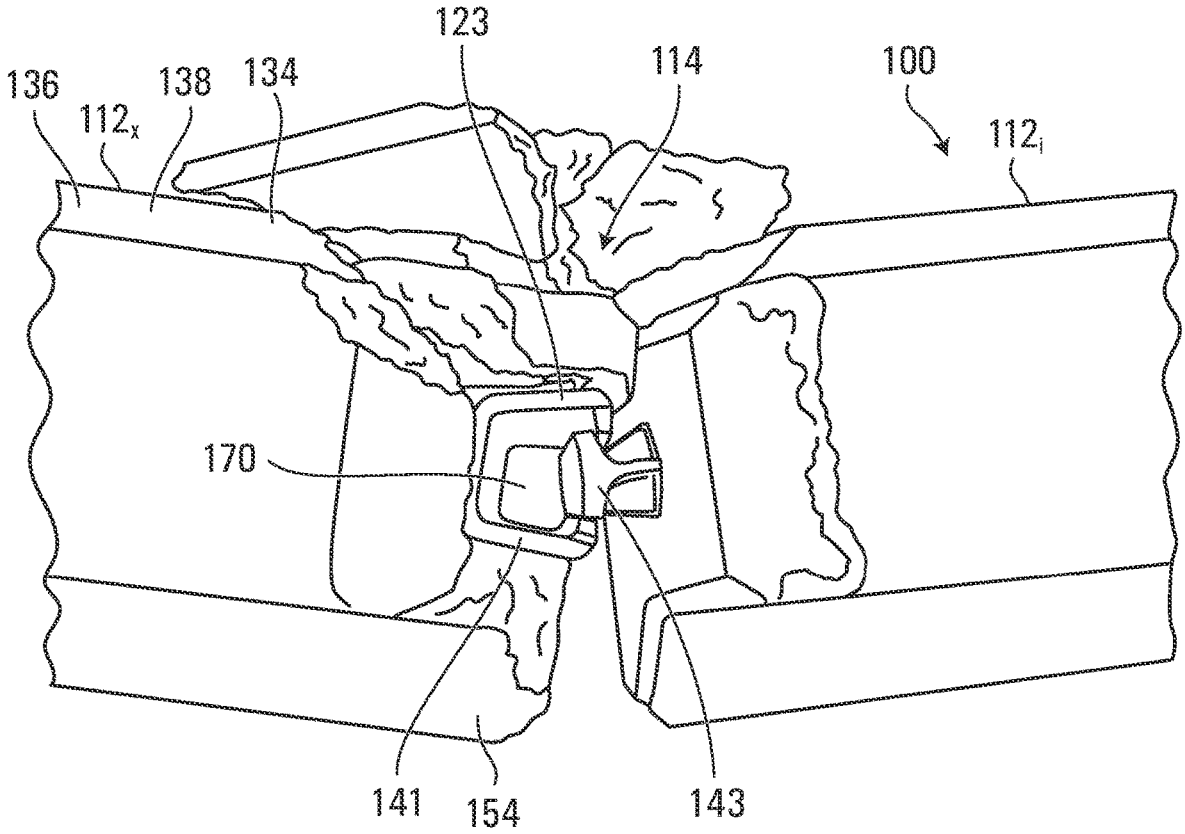
FIG. 13 (Prior Art)
FIG. 13 shows a top view of a connection system of a prior barrier which has been deflected by impact of a vehicle.

For instance, in FIG. 13 there is shown a prior barrier 100 comprising a plurality of barrier modules 112. Each of the barrier modules 112 includes a body 136 comprising concrete 138. The barrier 100 comprises a connection system 114 to interconnect the barrier modules 112. The connection system 114 includes connections 123 of respective ones of the barrier modules 12 that are adjacent. As part of the connection system 114 of the barrier 100, each barrier module 112 comprises connectors 141, 143 configured to connect the barrier module 112 to one or more adjacent barrier modules 112 (e.g., to connect a barrier module $\mathbf{112}_x$ to adjacent barrier module 1121).

In this case, the barrier 100 has been impacted by an impacting vehicle such that the barrier 100 is deflected and damaged. With continued reference to FIG. 13, the barrier modules $\mathbf{112}_x$, 1121 of the barrier 100 have pivoted relative to one another due to the impact of the vehicle. In this case, the concrete 138 of each of the barrier modules $\mathbf{112}_x$, 1121 has been damaged (e.g., has been broken) due to the pivoting of the barrier modules $\mathbf{112}_x$, $\mathbf{112}_i$. More specifically, the concrete 138 in a base portion 134 of each of the barrier module $\mathbf{112}_x$, 1121 has been damaged.

Additionally, the connector $\mathbf{141}_x$ of the barrier module $\mathbf{112}_x$ has also been deformed due to the pivoting of the barrier modules $\mathbf{112}_x$, $\mathbf{112}_i$. More specifically, connector $\mathbf{141}_x$ of the barrier module $\mathbf{112}_x$ has been enlarged due to the pivoting of the barrier modules $\mathbf{112}_x$, $\mathbf{112}_i$ (i.e., a cavity 170 of the connector $\mathbf{141}_x$ of the barrier module $\mathbf{112}_x$ has been enlarged due to the pivoting of the barrier modules $\mathbf{112}_x$, $\mathbf{112}_i$).

With continued reference to FIGS. 5 and 7, in this embodiment, the connector 41 of the barrier module 12 of the barrier 10 comprises a reinforcement 16. As further discussed below, the reinforcement 16 provides protection against (e.g., prevents or reduces) deformation, breakage and/or other deterioration of the connectors 41, 43 and/or the concrete 38 of adjacent ones of the barrier modules 12 of the barrier 10 that may move relative to one another (e.g., when impacted by vehicles).

The reinforcement 16 may comprise any suitable material 62. For instance, the reinforcement 16 may comprise a metallic material (e.g., steel). In some embodiments, the material 62 of the reinforcement 16 is different from the material 64 of the connector 41 of the barrier module 12. For instance, the metallic material of the reinforcement 16 may be different from the metallic material of the connector 41 of the barrier module 12.

In this embodiment, the reinforcement 16 is embedded in the concrete 38 of the barrier module 12. More particularly, in this example of implementation, the reinforcement 16 is completely enclosed by the concrete 38 of the barrier module 12. Also, in this example of implementation, the reinforcement 16 is spaced from the armature 40 within the concrete 38 of the barrier module 12.

In this embodiment, the reinforcement 16 extends in the base portion 34 of the barrier module 12 towards corners 54 of the base portion 34 of the barrier module 12.

Taking for instance a case where the barrier module 12 pivots relative to an adjacent barrier module 12, in this embodiment, the reinforcement 16 is configured to maintain integrity of the concrete 38 of the base portion 34 of the barrier module 12 when the adjacent barrier module 12 pivots relative to the barrier module 12. Accordingly, the reinforcement 16 is configured to protect the concrete 38 of the base portion 34 of the barrier module 12 against breakage of the concrete 38 of the base portion 34 of the barrier module 12 when an adjacent barrier module 12 pivots relative to the barrier module 12.

A widthwise dimension of the reinforcement 16 may have any suitable value. In some embodiments, the reinforcement 16 may span at least a majority of the width $W_M$ of the barrier module 12. For example, in some cases the reinforcement 16 may span at least two-thirds of the width $W_M$ of the barrier module 12, and in some cases at least three-quarters of the width $W_M$ of the barrier module 12.

With continued reference to FIGS. 5 and 7, in this embodiment, the reinforcement 16 includes a void 52 and the concrete 38 of the barrier module 12 extends into the void 52 of the reinforcement 16. In this example, the void 52 includes a plurality of openings 56 and the concrete 38 of the barrier module 12 extends into each of the openings 56 of the reinforcement 16.

In this example of implementation of the embodiment, the reinforcement 16 includes reinforcing legs 58, 60 disposed in the base portion 34 of the barrier module 12 and extending opposite one another in the widthwise direction of the barrier module 12. Each of the reinforcing legs 58, 60 includes the openings 56 and the concrete 38 of the barrier module 12 extends into the opening 56 of each of the reinforcing legs 58, 60.

As shown in FIGS. 5 and 7, the reinforcing legs 58, 60 extend from respective ones of the opposite sides 26, 28 of the vertical engageable part 72 of the connector 41 of the barrier module 12.

Also, in this embodiment, the reinforcement 16 is configured to maintain a shape of the connector 41 of the barrier module 12 when an adjacent barrier module 12 pivots relative to the barrier module 12. As such, the reinforcement 16 is configured to protect the connector 41 of the barrier module 12 against deformation of the connector 41 of the barrier module 12 when an adjacent barrier module 12 pivots relative to the barrier module 12. Therefore, the reinforcement 16 is configured to oppose a tendency of the connector 41 of the barrier module 12 to deform when an adjacent barrier module 12 pivots relative to the barrier module 12. Thus, the reinforcement 16 is configured to at least reduce deformation (i.e., prevent or reduce deformation) of the connector 41 of the barrier module 12 when an adjacent barrier module 12 pivots relative to the barrier module 12.

More particularly, in this embodiment, the reinforcement 16 is configured to oppose a tendency of the cavity 70 of the connector 41 of the barrier module 12 to be enlarged when an adjacent barrier module 12 pivots relative to the barrier module 12. As such, the reinforcement 16 is configured to protect the connector 41 of the barrier module 12 against enlargement of the cavity 70 of the connector 41 of the barrier module 12 when an adjacent barrier module 12 pivots relative to the barrier module 12. Therefore, the reinforcement 16 is configured to oppose a tendency of the cavity 70 of the connector 41 of the barrier module 12 to be enlarged when an adjacent barrier module 12 pivots relative to the barrier module 12. Thus, the reinforcement 16 is configured to at least reduce enlargement of the cavity 70 of the connector 41 the barrier module 12 when an adjacent barrier module 12 pivots relative to the barrier module 12.

With reference to FIG. 5, in this embodiment, the reinforcement 16 of the connector 41 is C-shaped when viewed in the heightwise direction of the barrier module 12. In this embodiment, the reinforcement 16 comprises a flange 66. For instance, in some cases, the flange 66 is a rib.

In some embodiments, the reinforcement 16 extends at least along respective ones of the opposite sides 26, 28 of the vertical engageable part 72 of the connector 41 of the barrier module 12 such that the reinforcement 16 extends along at least a portion (e.g., a portion or an entirety) of each of the lateral walls 44, 46 of the vertical engageable part 72 of the connector 41 of the barrier module 12. In this embodiment, as shown in FIG. 5, the reinforcement 16 extends along each of the lateral walls 44, 46 and the end wall 48 of the vertical engageable part 72 of the connector 41 of the barrier module 12.

The reinforcement 16 may be affixed to the vertical engageable part 72 of the connector 41 of the barrier module 12 in any suitable fashion. In some embodiments, the reinforcement 16 is fastened to the vertical engageable part 72 of the connector 41 of the barrier module 12. For instance, in some embodiments, the reinforcement 16 is welded to the vertical engageable part 72 of the connector 41 of the barrier module 12. In other embodiments, the reinforcement 16 may be molded integrally (e.g., cast or forged) with the vertical engageable part 72 of the connector 41 of the barrier module 12.

With reference to FIG. 5, in this embodiment, the reinforcement 16 of the connector 41 of the barrier module 12 includes a plurality of reinforcing members 50 spaced from one another. More particularly, in this embodiment, the reinforcing members 50 of the connector 41 of the barrier module 12 are spaced from one another in the heightwise direction of the barrier module 12. In this example, the reinforcing members 50 are disposed between (and in this case spaced from) the anchors 51 in the heightwise direction of the barrier module 12.

In this embodiment, each of the reinforcing members 50 of the connector 41 is C-shaped when viewed in the heightwise direction of the barrier module 12. In some embodiments, each of the reinforcing members 50 comprises a flange 68. For instance, in some cases, the flange 68 may comprise a rib.

In some embodiments, each of the reinforcing members 50 extends at least along respective ones of the opposite sides 26, 28 of the vertical engageable part 72 of the connector 41 of the barrier module 12 such that each of the reinforcing members 50 extends along at least a portion (e.g., a portion or the entirety) of each of the lateral walls 44, 46 of the vertical engageable part 72 of the connector 41 of the barrier module 12. In this embodiment, as shown in FIG. 5, each of the reinforcing members 50 extends at least along each of the lateral walls 44, 46 and the end wall 48 of the vertical engageable part 72 of the connector 41 of the barrier module 12.

Each of the reinforcing members 50 may be affixed to the vertical engageable part 72 of the connector 41 of the barrier module 12 in any suitable fashion. In some embodiments, each of the reinforcing members 50 is fastened to the vertical engageable part 72 of the connector 41 of the barrier module 12. For instance, in some embodiments, each of the reinforcing members 50 is welded to the vertical engageable part 72 of the connector 41 of the barrier module 12. In other embodiments, each of the reinforcing members 50 is molded integrally (e.g., cast or forged) with the vertical engageable part 72 of the connector 41 of the barrier module 12.

In this embodiment, the male connector 43 of the barrier module 12 may comprise a reinforcement 16 which may be implemented similarly to the reinforcement 16 described above with respect to the female connector 41 of the barrier module 12. For example, in this embodiment, as shown in FIGS. 6 and 8, the reinforcement 16 of the male connector 43 includes reinforcing legs 58, 60.

In this embodiment, as shown in FIG. 6, the reinforcement 16 extends at least along respective ones of the opposite sides 26, 28 of the vertical engageable part 73 of the connector 43 of the barrier module 12. In this case, the reinforcing legs 58, 60 extend from opposite sides 26, 28 of the vertical engageable part 73 of the connector 43 of the barrier module 12.

In other embodiments, the reinforcement 16 may extend along at least a portion (i.e., a portion or the entirety) of each of the opposite sides 26, 28 of the vertical engageable part 72 of the connector 43 of the barrier module 12 such that the reinforcement 16 may extend continuously from the opposite side 26 to the opposite side 28 of the vertical engageable part 72 of the connector 43. In such cases, the reinforcement 16 circumscribes at least a portion of a periphery 63 of the vertical engageable part 72 of the connector 43 of the barrier module 12.

In this example of implementation, the reinforcement 16 of the male connector 43 does not include reinforcing members 50. However, in other embodiments, the reinforcement 16 of the male connector 43 may include reinforcing members 50.

In various embodiments, part or all of the reinforcement 16 may be positioned in any suitable location along the longitudinal direction of the barrier module 12.

Figure 18:
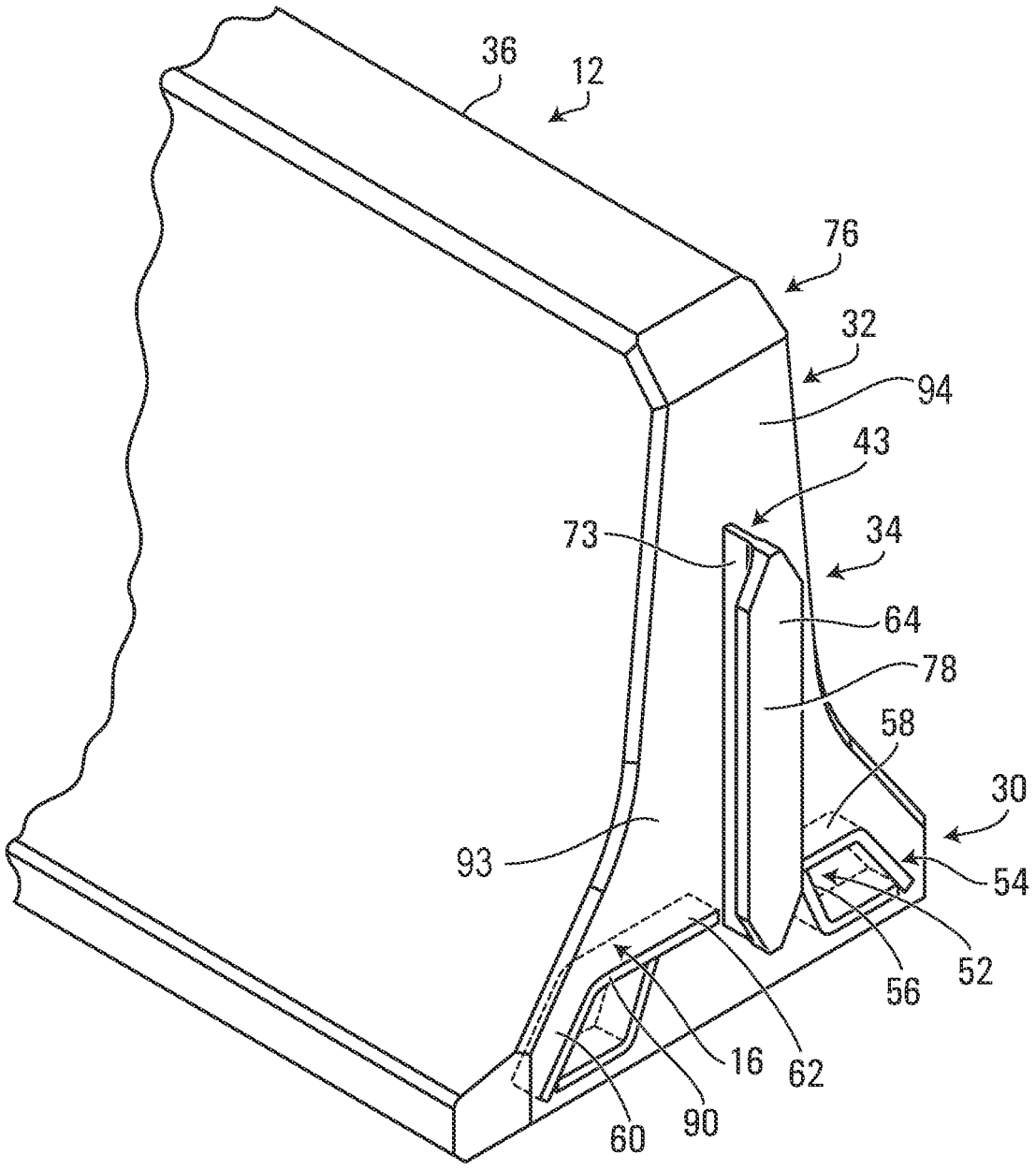
FIGS. 18 to 20 show embodiments where part of the reinforcement of the barrier module is located in various positions along a longitudinal direction of the barrier module.

For example, in some embodiments, as shown in FIG. 18, the reinforcing legs 58, 60 may be disposed such that a lateral surface 90 of each of the reinforcing legs 58, 60 is substantially flush (e.g., coplanar) with a surface 93 of the concrete 38 of the barrier module 12 such that the lateral surface 90 of the each of the reinforcing legs 58, 60 and the surface 93 of the concrete 38 constitute respective portions of an end surface 94 of the end 76 of the barrier module 12 and the lateral surface 90 of each of the reinforcing legs 58, 60 is visible (i.e., exposed) at the end 76 of the barrier module 12. A remainder of each of the reinforcing legs 58, 60 is embedded in the concrete 38 of the body 36 of the barrier module 12 as denoted in dotted lines in FIG. 18.

Figure 19:
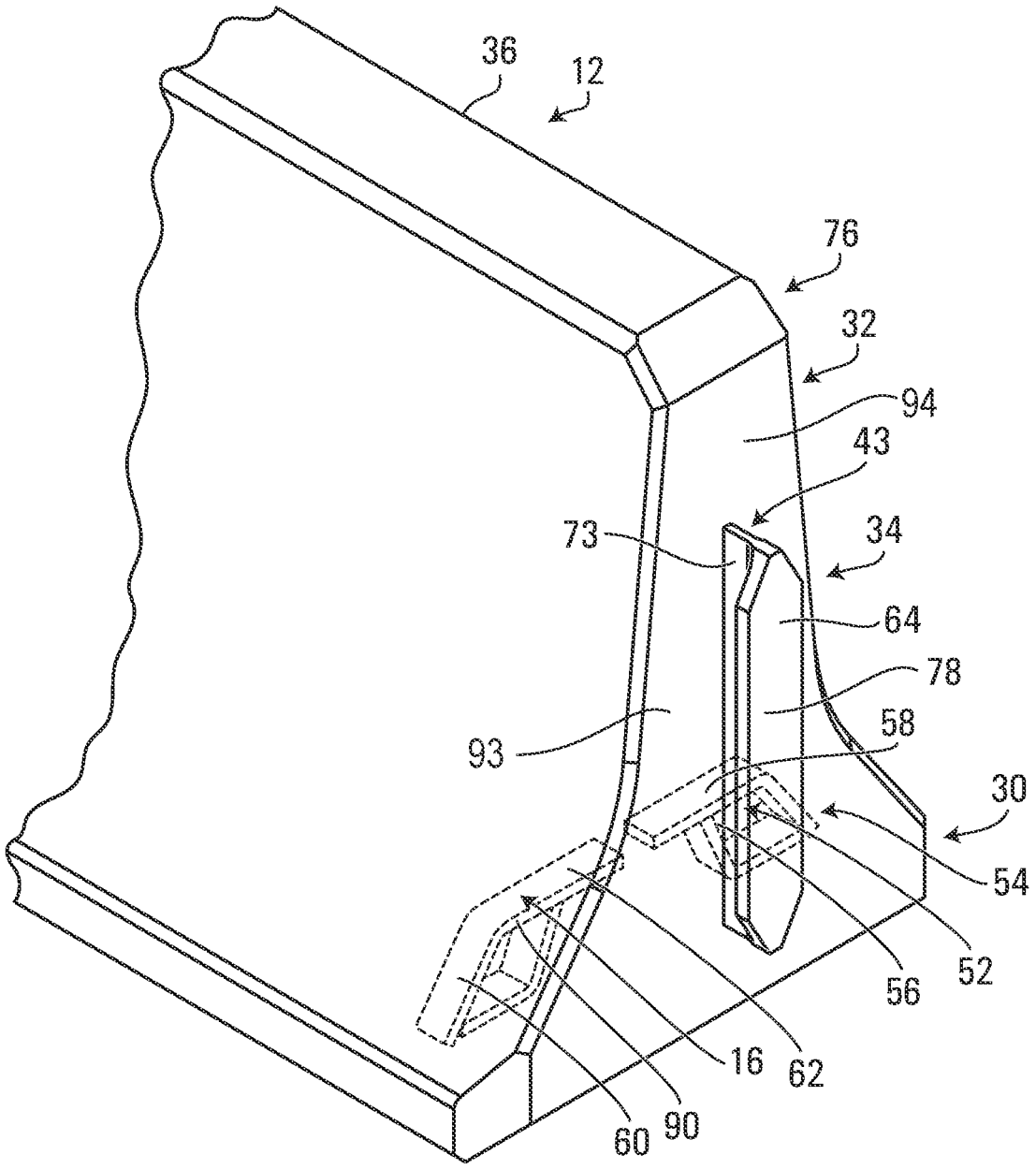

In another example, in some embodiments, as shown in FIG. 19, the reinforcing legs 58, 60 may be spaced from the end surface 94 of the end of the barrier module 12 so that the reinforcing legs 58, 60 are fully embedded in and concealed by the concrete 38 of the body 36 of the barrier module 12 as shown in dotted lines in FIG. 19. A portion (e.g., layer) of the concrete 38 between the reinforcing legs 58, 60 and the end surface 94 of the barrier module 12 may have any suitable thickness (e.g., in some cases less than 1 inch, in some cases more than 1 inch, such as a few inches).

Figure 20:
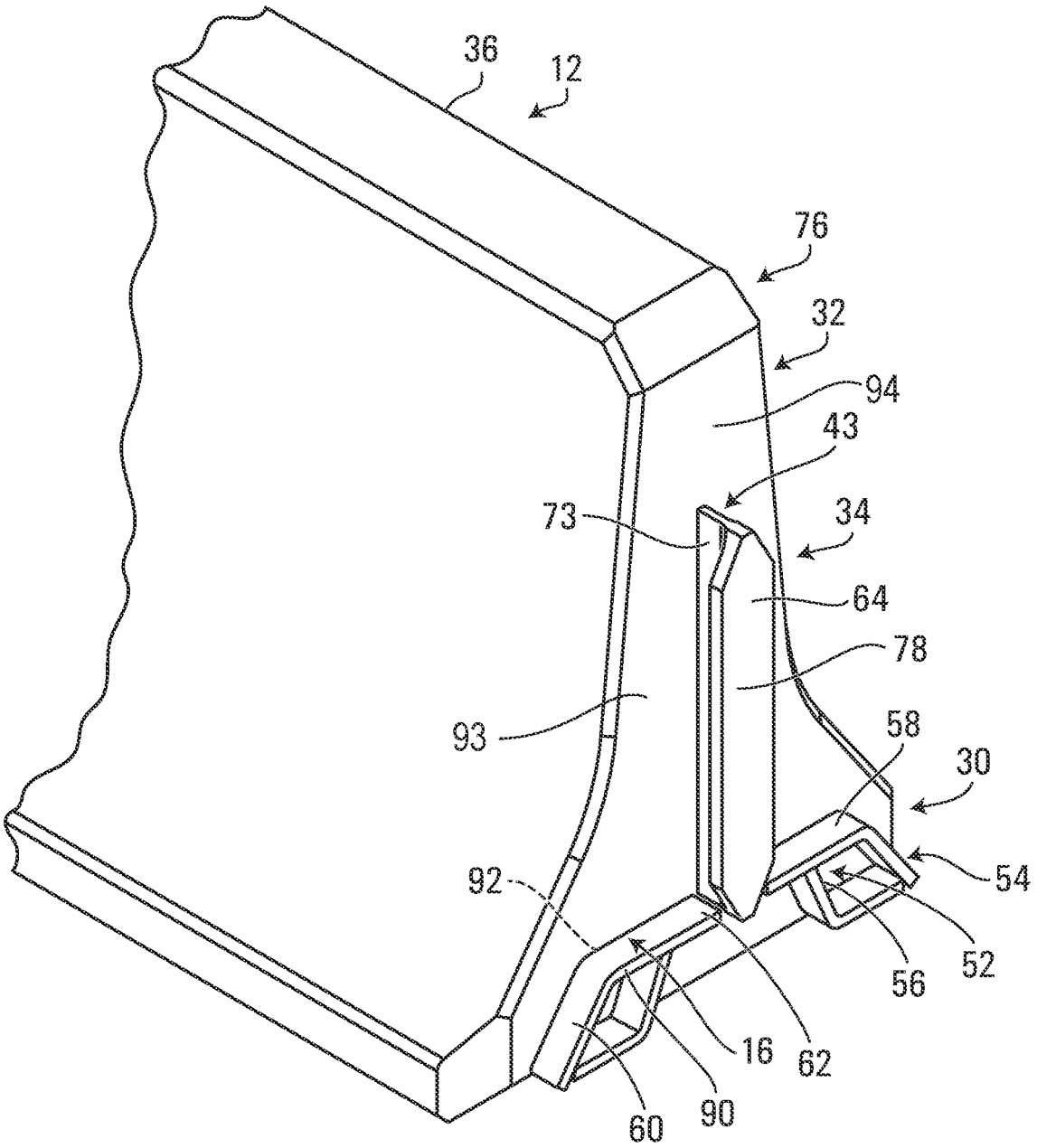

In yet another example, in some embodiments, as shown in FIG. 20, the reinforcing legs 58, 60 may be at least partially disposed outside the concrete 38 of the body 36 of the barrier module 12. For instance, in some cases, the reinforcing legs 58, 60 are partially embedded in the concrete 38 of the body 36 of the barrier module 12 and protrude outwardly from (i.e., project beyond) the concrete 38. In other cases, the reinforcing legs 58, 60 may be disposed completely outside the concrete 38 of the body 36 of the barrier module 12 such that they are not embedded in the concrete 38 of the body 36 of the barrier module 12. In some instances, a lateral surface 92 of the reinforcing legs 58, 60, opposite to the lateral surface 90 of the reinforcing legs 58, 60, may be configured to contact the concrete 38 of the body 36 of the barrier module 12. In other instances, the lateral surface 92 of the reinforcing legs 58, 60 may be configured not to contact the concrete 38 of the body 36 of the barrier module 12 such that the lateral surface 92 is free from contact with the concrete 38 of the body 36 of the barrier module 12.

Figure 14:
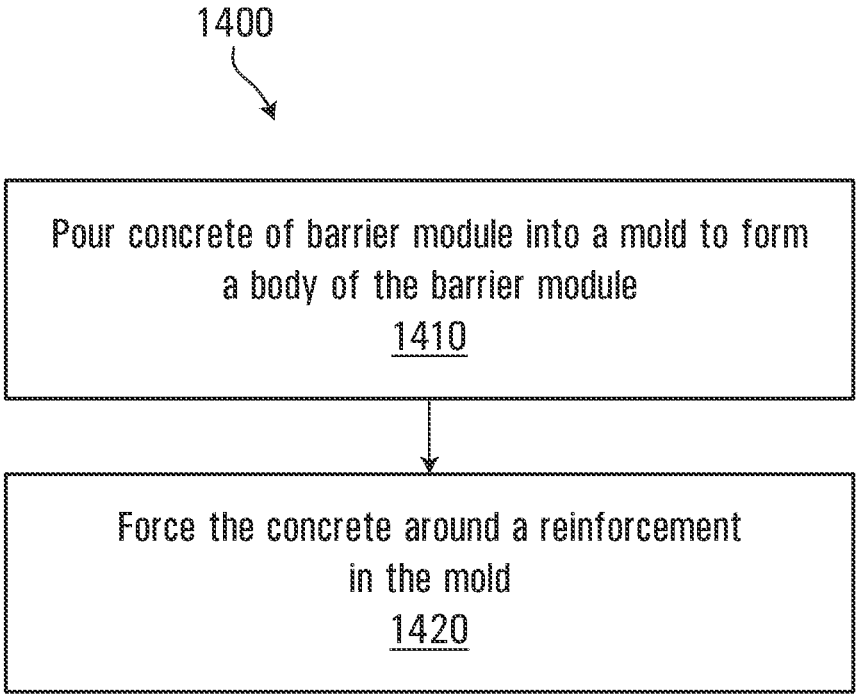
FIG. 14 is a flowchart illustrating steps of a method of manufacturing a barrier module, in accordance with one embodiment.

The barrier 10, including its barrier modules 12, may be manufactured in accordance with any suitable method. An overview of a method 1300 of manufacturing a barrier module 12 that may be performed in some embodiments is now presented with reference to FIG. 14.

The method includes, at step 1410, pouring the concrete 38 of the barrier module 12 into a mold to form the body 36 of the barrier module 12. The method further includes, at step 1420, forcing the concrete 38 around the reinforcement 16 in the mold. In some embodiments, the concrete 38 may be forced around the reinforcement 16 in the mold by pushing the concrete 38 with a tool separate from the mold (e.g., such that the concrete 38 extends to edges of the mold, including around the reinforcing legs 58, 60 and through the openings 56 of the reinforcement 16).

In some embodiments, the barrier 10 may reduce deflection, by deflecting less or substantially not deflecting, when impacted by vehicles.

Figure 9:
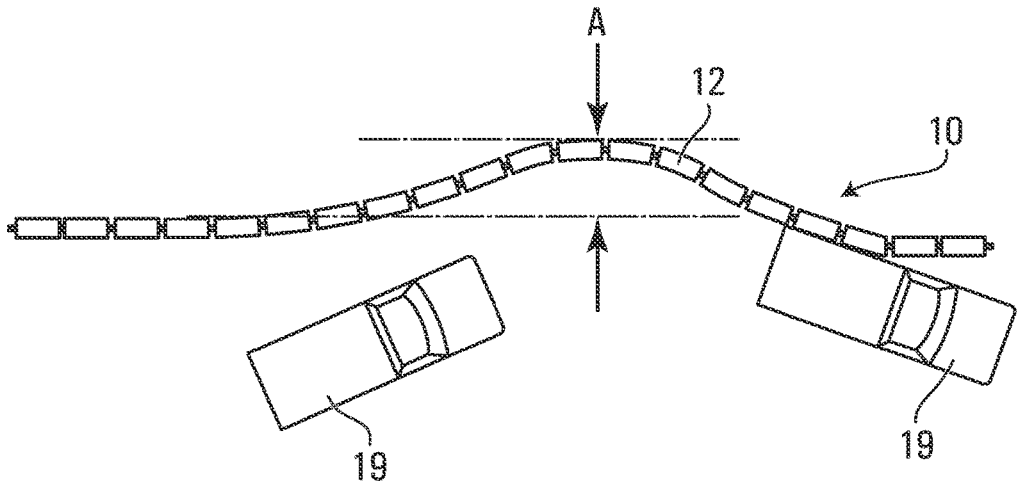
FIG. 9 shows schematic of a top view of the barrier deflected upon impact of a vehicle.

For example, in some embodiments, with additional reference to FIG. 9, the barrier 10 is configured to deflect by no more than 1.6 meters (m) according to MASH, i.e., the Manual for Assessing Safety Hardware produced by the American Association of State Highway and Transportation Officials (AASHTO), published as a 2nd edition in 2016, accessible at https://bookstore.transportation.org/, and incorporated by reference herein. Specifically, the barrier 10 may be configured to deflect by no more than 1.6 m in accordance with MASH test nos. 3-10 or 3-11. An example of such a deflection A is shown in FIG. 9. For instance, in some embodiments, the barrier 10 may be configured to deflect by no more than 1.4 m, in some cases no more than 1.2 m, in some cases no more than 1.0 m, and in some cases even less, in accordance with MASH test nos. 3-10 and 3-11.

The barrier 10 (e.g., its barrier modules 12) may be implemented in various other ways in other embodiments.

Figure 10:
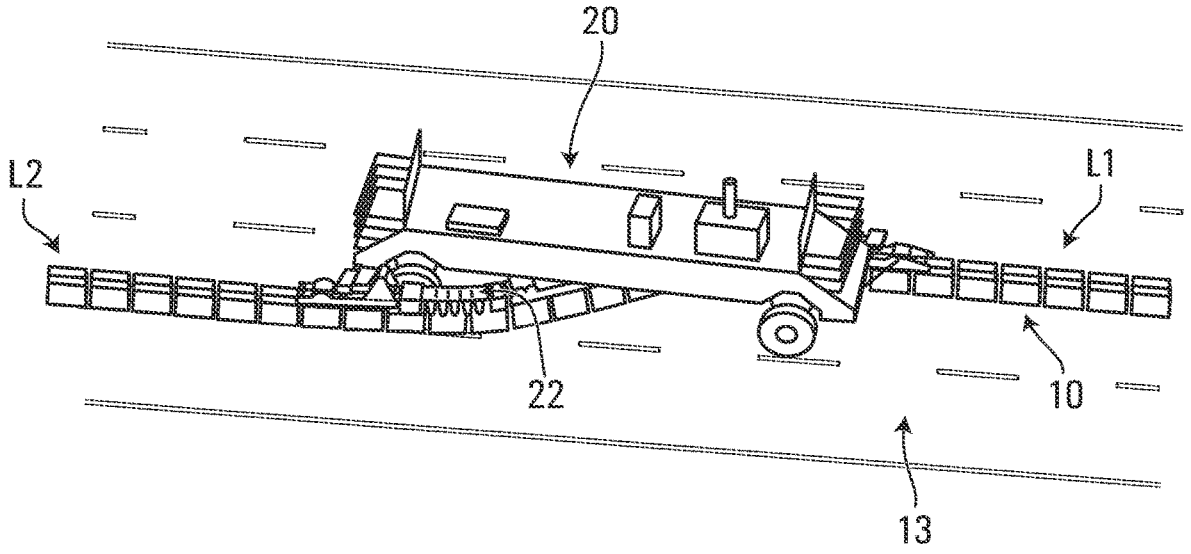
FIG. 10 shows a transfer vehicle that can be used to move the barrier on the roadway in another embodiment.
Figure 11:
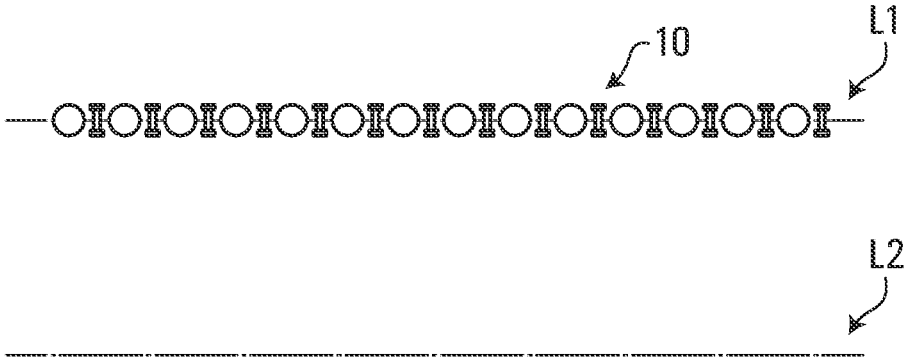
FIG. 11 shows a schematic of the barrier in a first location.
Figure 12:
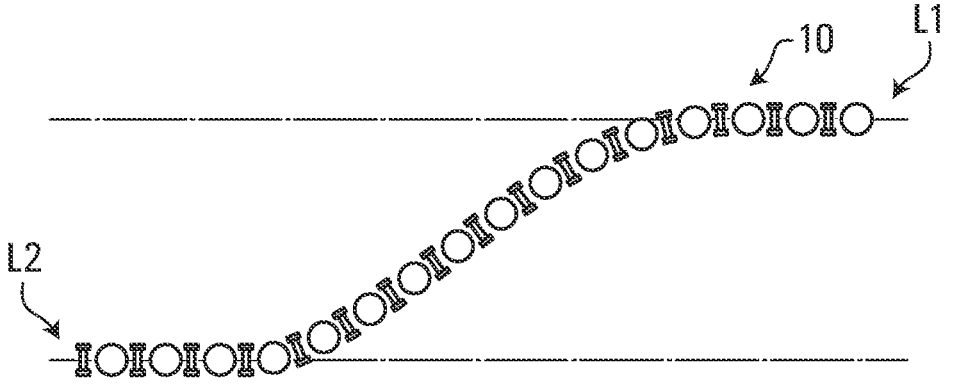
FIG. 12 shows a schematic of the barrier as transferred to a second location.

For example, in other embodiments, as shown in FIGS. 10 to 12, the barrier 10 may be a movable barrier configured to be transferred between different locations $L_1$, $L_2$ at the roadway 13 by a transfer vehicle 20, such as for lane management (e.g., reconfiguring lanes, such as for peak traffic times (e.g., "rush hour"), etc.), roadwork (e.g., construction sites to build or repair roads), etc.

For instance, in this embodiment, the transfer vehicle 20 comprises a conveyor 22 to admit the barrier modules 12 at the location $L_1$ at the roadway 13 and transfer them towards and release them at the location $L_2$ at the roadway 13 as the transfer vehicle 20 travels at the roadway 13, as shown in FIGS. 10 to 12. The transfer vehicle 20, including its conveyor 22, may be implemented in any suitable way. For example, in some embodiments, the transfer vehicle 20, including its conveyor 22, may be implemented as one available from QMB Barrier™ (http://www.qmb.ca/index_en.html), as one available from Barrier Systems™ (http://www.barriersystemsinc.com/), as one described in U.S. Pat. No. 4,653,954, or as any other suitable transfer vehicle.

One or more features of the barrier 10 described herein when the barrier 10 is fixed and/or permanent may be implemented when the barrier 10 is movable.

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Any feature of any embodiment discussed herein may be combined with any feature of any other embodiment discussed herein in some examples of implementation.

In case of any discrepancy, inconsistency, or other difference between terms used herein and terms used in any document incorporated by reference herein, meanings of the terms used herein are to prevail and be used.

Although various embodiments have been illustrated, this was for purposes of describing, but should not be limiting. Various changes, modifications and enhancements may be made.

The invention claimed is:

1. A barrier for a roadway, the barrier comprising a plurality of barrier modules connected to one another, wherein: a given one of the barrier modules comprises a base portion, an upper portion, and an intermediate portion between the base portion and the upper portion, the base portion of the given one of the barrier modules being wider than the intermediate portion of the given one of the barrier modules, the given one of the barrier modules further comprises a connector; an adjacent one of the barrier modules that is adjacent to the given one of the barrier modules comprises a connector for connecting to the connector of the given one of the barrier modules; and the connector of the given one of the barrier modules comprises a reinforcement extending in the base portion of the given one of the barrier modules towards corners of the base portion of the given one of the barrier modules.

2. The barrier of claim 1, wherein the reinforcement is configured to maintain a shape of the connector of the given one of the barrier modules when the adjacent one of the barrier modules pivots relative to the given one of the barrier modules.

3. The barrier of claim 1, wherein the reinforcement is configured to protect the connector of the given one of the barrier modules against deformation of the connector of the given one of the barrier modules when the adjacent one of the barrier modules pivots relative to the given one of the barrier modules.

4. The barrier of claim 1, wherein the reinforcement is configured to oppose a tendency of the connector of the given one of the barrier modules to deform when the adjacent one of the barrier modules pivots relative to the given one of the barrier modules.

5. The barrier of claim 1, wherein the reinforcement is configured to at least reduce deformation of the connector of the given one of the barrier modules when the adjacent one of the barrier modules pivots relative to the given one of the barrier modules.

6. The barrier of claim 1, wherein: the connector of the given one of the barrier modules includes a cavity to receive the connector of the adjacent one of the barrier modules; and the reinforcement is configured to protect the connector of the given one of the barrier modules against enlargement of the cavity of the connector of the given one of the barrier modules when the adjacent one of the barrier modules pivots relative to the given one of the barrier modules.

7. The barrier of claim 1, wherein: the connector of the given one of the barrier modules includes a cavity to receive the connector of the adjacent one of the barrier modules; and the reinforcement is configured to oppose a tendency of the cavity of the connector of the given one of the barrier modules to be enlarged when the adjacent one of the barrier modules pivots relative to the given one of the barrier modules.

8. The barrier of claim 1, wherein: the connector of the given one of the barrier modules includes a cavity to receive the connector of the adjacent one of the barrier modules; and the reinforcement is configured to at least reduce enlargement of the cavity of the connector of the given one of the barrier modules when the adjacent one of the barrier modules pivots relative to the given one of the barrier modules.

9. The barrier of claim 1, wherein: the connector of the given one of the barrier modules comprises a vertical engageable part configured to engage the connector of the adjacent one of the barrier modules; and the reinforcement extends at least along opposite sides of the vertical engageable part of the connector of the given one of the barrier modules.

10. The barrier of claim 1, wherein: the connector of the given one of the barrier modules comprises a vertical engageable part configured to engage the connector of the adjacent one of the barrier modules; the vertical engageable part of the connector of the given one of the barrier modules comprises lateral walls spaced apart in a widthwise direction of the given one of the barrier modules; and the reinforcement extends at least along each of the lateral walls of the vertical engageable part of the connector of the given one of the barrier modules.

11. The barrier of claim 10, wherein: the vertical engageable part of the connector of the given one of the barrier modules comprises an end wall between the lateral walls; and the reinforcement extends at least along each of the lateral walls and the end wall of the vertical engageable part of the connector of the given one of the barrier modules.

12. The barrier of claim 1, wherein the reinforcement is C-shaped when viewed in a heightwise direction of the given one of the barrier modules.

13. The barrier of claim 1, wherein the reinforcement comprises a flange.

14. The barrier of claim 1, wherein the reinforcement comprises a plurality of reinforcing members spaced from one another.

15. The barrier of claim 14, wherein the reinforcing members are spaced from one another in a heightwise direction of the given one of the barrier modules.

16. The barrier of claim 14, wherein: the connector of the given one of the barrier modules comprises a vertical engageable part configured to engage the connector of the adjacent one of the barrier modules; and each of the reinforcing members extends at least along opposite sides of the vertical engageable part of the connector of the given one of the barrier modules.

17. The barrier of claim 14, wherein each of the reinforcing members is C-shaped when viewed in a heightwise direction of the given one of the barrier modules.

18. The barrier of claim 14, wherein each of the reinforcing members comprises a flange.

19. The barrier of claim 14, wherein: the given one of the barrier modules comprises elongate anchors extending from the connector of the given one of the barrier modules towards a center of the given one of the barrier modules in a longitudinal direction of the barrier modules; and the reinforcing members are disposed between respective ones of the elongate anchors in the heightwise direction of the given one of the barrier modules.

20. The barrier of claim 1, wherein the connector of the adjacent one of the barrier modules is configured to hook into the connector of the given one of the barrier modules.

21. The barrier of claim 1, wherein: each of the barrier modules comprises a body including concrete; and the reinforcement is configured to maintain integrity of the concrete of the base portion of the given one of the barrier modules when the adjacent one of the barrier modules pivots relative to the given one of the barrier modules.

22. The barrier of claim 1, wherein: each of the barrier modules comprises a body including concrete; and the reinforcement is configured to protect the concrete of the base portion of the given one of the barrier modules against breakage of the concrete of the base portion of the given one of the barrier modules when the adjacent one of the barrier modules pivots relative to the given one of the barrier modules.

23. The barrier of claim 1, wherein the reinforcement spans at least a majority of a width of the given one of the barrier modules.

24. The barrier of claim 1, wherein the reinforcement comprises reinforcing legs disposed in the base portion of the given one of the barrier modules and extending opposite one another in a widthwise direction of the given one of the barrier modules.

25. The barrier of claim 24, wherein: the connector of the given one of the barrier modules comprises a vertical engageable part configured to engage the connector of the adjacent one of the barrier modules; and the reinforcing legs extend from opposite sides of the vertical engageable part of the connector of the given one of the barrier modules.

26. The barrier of claim 24, wherein: each of the barrier modules comprises a body including concrete; and at least part of each of the reinforcing legs is visible and uncovered by the concrete of the given one of the barrier modules.

27. The barrier of claim 24, wherein: each of the barrier modules comprises a body including concrete; and each of the reinforcing legs is completely embedded in and concealed by the concrete of the given one of the barrier modules.

28. The barrier of claim 1, wherein: each of the barrier modules comprises a body including concrete and an armature embedded in the concrete; at least part of the connector of the given one of the barrier modules is disposed outside the concrete of the given one of the barrier modules; and the reinforcement is embedded in the concrete of the given one of the barrier modules.

29. The barrier of claim 1, wherein the barrier is configured to deflect by no more than 1.6 meters according to MASH.

30. A barrier for a roadway, the barrier comprising a plurality of barrier modules connected to one another, each of the barrier modules comprising a body including concrete, wherein: a given one of the barrier modules comprises a base portion, an upper portion, and an intermediate portion between the base portion and the upper portion, the base portion of the given one of the barrier modules being wider than the intermediate portion of the given one of the barrier modules, the given one of the barrier modules further comprises a connector; an adjacent one of the barrier modules that is adjacent to the given one of the barrier modules comprises a connector for connecting to the connector of the given one of the barrier modules; and the connector of the given one of the barrier modules comprises a reinforcement embedded in the concrete of the given one of the barrier modules, the reinforcement extending in the base portion of the given one of the barrier modules towards corners of the base portion of the given one of the barrier modules.

31. A barrier for a roadway, the barrier comprising a plurality of barrier modules connected to one another, wherein: a given one of the barrier modules comprises a base portion, an upper portion, and an intermediate portion between the base portion and the upper portion, the base portion of the given one of the barrier modules being wider than the intermediate portion of the given one of the barrier modules, the given one of the barrier modules further comprises a connector; an adjacent one of the barrier modules that is adjacent to the given one of the barrier modules comprises a connector for connecting to the connector of the given one of the barrier modules; and the connector of the given one of the barrier modules comprises a reinforcement configured to maintain a shape of the connector of the given one of the barrier modules when the adjacent one of the barrier modules pivots relative to the given one of the barrier modules, the reinforcement extending in the base portion of the given one of the barrier modules towards corners of the base portion of the given one of the barrier modules.

* * * * *